US009093765B2

(12) United States Patent
Kuji et al.

(10) Patent No.: US 9,093,765 B2
(45) Date of Patent: Jul. 28, 2015

(54) CONNECTOR AND WIRE HARNESS

(71) Applicant: Hitachi Metals, Ltd., Tokyo (JP)

(72) Inventors: Tomoya Kuji, Yokohama (JP); Sachio Suzuki, Hitachi (JP); Yuta Kataoka, Hitachi (JP); Jun Umetsu, Hitachi (JP); Takanori Komuro, Hitachi (JP)

(73) Assignee: HITACHI METALS, LTD., Tokyo (JP)

( * ) Notice: Subject to any disclaimer, the term of this patent is extended or adjusted under 35 U.S.C. 154(b) by 0 days.

(21) Appl. No.: 14/227,204

(22) Filed: Mar. 27, 2014

(65) Prior Publication Data

US 2014/0291017 A1 Oct. 2, 2014

(30) Foreign Application Priority Data

Mar. 29, 2013 (JP) ..... 2013-073082

(51) Int. Cl.
*H01R 13/15* (2006.01)
*H01R 13/193* (2006.01)
*H01R 13/641* (2006.01)

(52) U.S. Cl.
CPC ..... *H01R 13/193* (2013.01); *H01R 13/641* (2013.01)

(58) Field of Classification Search
CPC .... H01R 13/193; H01R 13/26; H01R 13/631; H01R 13/629
See application file for complete search history.

(56) References Cited

U.S. PATENT DOCUMENTS

| | | | | |
|---|---|---|---|---|
| 8,272,891 | B2 * | 9/2012 | Kataoka et al. | 439/540.1 |
| 8,277,259 | B2 * | 10/2012 | Hattori et al. | 439/660 |
| 8,308,508 | B2 * | 11/2012 | Suzuki et al. | 439/540.1 |
| 8,517,753 | B2 * | 8/2013 | Kataoka et al. | 439/261 |
| 8,608,498 | B2 * | 12/2013 | Suzuki et al. | 439/262 |
| 8,608,499 | B2 * | 12/2013 | Umetsu et al. | 439/262 |
| 8,734,173 | B2 * | 5/2014 | Suzuki et al. | 439/262 |

FOREIGN PATENT DOCUMENTS

| | | |
|---|---|---|
| JP | 2002-343506 | 11/2002 |
| JP | 2012-134131 | 7/2012 |

* cited by examiner

*Primary Examiner* — Xuong Chung Trans
(74) *Attorney, Agent, or Firm* — Roberts Mlotkowski Safran & Cole, P.C.

(57) ABSTRACT

A connector includes a first terminal housing for housing first connecting terminals, a second terminal housing for housing second connecting terminals, insulating members aligned and housed in the second terminal housing, a connecting member for rotating a cam in a tightening direction and thereby pressing each contact point, a first fitting detection terminal provided on one of the first and second terminal housings, a second fitting detection terminal provided on the other of the first and second terminal housings so as to be slidable along a fitting direction of the two terminal housings, and a slide means that makes the second fitting detection terminal slide in accordance with the rotation of the cam and electrically connects the first fitting detection terminal to the second fitting detection terminal when fitting the two terminals housings and then rotating the cam in the tightening direction.

9 Claims, 15 Drawing Sheets

CONNECTOR AND WIRE HARNESS

The present application is based on Japanese patent application No. 2013-073082 filed on Mar. 29, 2013, the entire contents of which are incorporated herein by reference.

BACKGROUND OF THE INVENTION

1. Field of the Invention

The invention relates to a connector to be suitably used for a power harness used in eco-friendly cars such as hybrid cars and electric cars especially to transmit a large amount of power, and a wire harness.

2. Description of the Related Art

A power harness is used for connecting between devices such as between a motor and an inverter or between an inverter and a battery in, e.g., a hybrid car or an electric car, which has made significant progress in recent years, for transmitting a large amount of power, and a connector in a two-divided structure composed of, e.g., a first connector portion provided with a first terminal(s) as well as a first terminal housing for housing the first terminal(s) and a second connector portion provided with a second terminal(s) connected to the first terminal(s) as well as a second terminal housing for housing the second terminal(s) is provided to one end of the power harness.

In recent years, all components in such eco-friendly cars have been lightened in weight in order to improve energy saving performance, and size reduction is desired as one of effective means of reducing weight.

The present applicant has proposed a laminated-type connector having a laminated structure in which, when a first terminal housing is fitted to a second terminal housing, plural first connecting terminals and plural second connecting terminals are alternately arranged so that surfaces of the first connecting terminals respectively face surfaces of the second connecting terminals to form pairs and plural contact points formed therebetween are sandwiched between the insulating members (Japanese patent No. 4, 905, 608).

In the connector of Japanese patent No. 4, 905, 608, a connecting member is provided to press an insulating member adjacent thereto to collectively fix and electrically connect the plural first connecting terminals to the plural second connecting terminals at each contact point, and an insulating member assembly is formed by connecting the plural insulating members to each other and restricts the insulating members from moving in a fitting direction and a width direction which is perpendicular to a lamination direction of the laminated structure and to the fitting direction.

Such a configuration realizes a small laminated-type connector by eliminating a retaining jig for holding the insulating members and also allows positional misalignment of the insulating members to be reduced even in the case that an excessive force is applied to a cable.

In the meantime, in a connector used for transmitting a large amount of power as described above, since spark may be generated by arc discharge if the fitting of the two terminal housings is released while an electric current is still flowing, which is dangerous for work and may damage terminals, etc.

Thus, a device to detect the fitting of two terminals and to interrupt an electric current when releasing the fitting of the two terminals (High Voltage Interlock Loop (HVIL) etc.) is sometimes provided.

Japanese patent No. 3,820,355 proposes a device configured that two terminal housings are fitted and a first fitting detection terminal provided on one of the terminal housings subsequently slides and comes into contact with a second fitting detection terminal provided on another terminal housing so that a power circuit is connected when the two fitting detection terminals are in a contact state and the power circuit is interrupted when the two fitting detection terminals are in a non-contact state.

SUMMARY OF THE INVENTION

If the technique of Japanese patent No. 3,820,355 is applied to a laminated-type connector, it is necessary to firstly fit two terminal housings and then to fix each contact point by operating a connecting member and further to slide the first fitting detection terminal. Therefore, it takes time and effort when fitting two terminal housings and connecting two connector portions, which is a problem in view of workability.

In addition, when the technique of Japanese patent No. 3,820,355 is applied to a laminated-type connector, two fitting detection terminals could be electrically connected by sliding of the first fitting detection terminal even in a state that each contact point is not fixed. Accordingly, there is a possibility that two terminal housings are detached even though two fitting detection terminals are still electrically connected and spark is generated, which is also a problem in view of safety.

It is an object of the invention to provide a laminated-type connector that can detect the fitting of terminal housings without impairing the workability and the safety of connection work, as well as a wire harness using the connector.

(1) According to one embodiment of the invention, a connector comprises:

a first terminal housing for housing a plurality of first connecting terminals aligned;

a second terminal housing for housing a plurality of second connecting terminals aligned;

a plurality of insulating members aligned and housed in the second terminal housing;

a laminated structure that the plurality of first connecting terminals and the plurality of second connecting terminals are alternately arranged so that one surface of the plurality of first connecting terminals faces one surface of the plurality of second connecting terminals to form pairs and to form a plurality of contact points sandwiched between the plurality of insulating members when the first terminal housing is fitted to the second terminal housing;

a connecting member for collectively fixing and electrically connecting the plurality of first connecting terminals and the plurality of second connecting terminals at each contact point by rotating a cam in a tightening direction and thereby pressing each contact point;

a first fitting detection terminal provided on one of the first and second terminal housings;

a second fitting detection terminal provided on the other of the first and second terminal housings so as to be slidable along a fitting direction of the two terminal housings; and a slide means that makes the second fitting detection terminal slide in accordance with the rotation of the cam and electrically connects the first fitting detection terminal to the second fitting detection terminal when fitting the two terminals housings and then rotating the cam in the tightening direction.

In the above embodiment (1) of the invention, the following modifications and changes can be made.

(i) The slide means is configured to electrically connect the first fitting detection terminal to the second fitting detection terminal after a pressing force is applied to each contact point when fitting the two terminals housings and then rotating the cam in the tightening direction.

(ii) The slide means is configured to electrically disconnect the first fitting detection terminal from the second fitting detection terminal when the cam is rotated from a tightened position in a direction opposite to the tightening direction.

(iii) The slide means is configured to electrically disconnect the first fitting detection terminal from the second fitting detection terminal and subsequently to release each contact point from the pressing force when the cam is rotated from the tightened position in the direction opposite to the tightening direction.

(iv) The connector further comprises a second fitting detection terminal case for holding the second fitting detection terminal, wherein the slide means comprises a case-side protrusion provided on the second fitting detection terminal case and a slide ring comprising a ring portion rotating integrally with the cam and a ring-side protrusion coming in contact with the case-side protrusion to slide the second fitting detection terminal case when the ring portion is rotated.

(v) The ring-side protrusion comprises two protrusions, a front protrusion formed along a circumferential direction of the ring portion and a rear protrusion, wherein the rear protrusion butts against the case-side protrusion to slide the second fitting detection terminal case when fitting the two terminals housings and then rotating the cam in the tightening direction, and wherein the front protrusion butts against the case-side protrusion to slide the second fitting detection terminal case in a direction opposite to the first fitting detection terminal when the cam is rotated from a tightened position in a direction opposite to the tightening direction.

(vi) The connector further comprises a case-side auxiliary protrusion formed on the second fitting detection terminal case on a front side in a sliding direction with respect to the case-side protrusion, wherein, when fitting the two terminals housings and then rotating the cam in the tightening direction, the front protrusion butts against the case-side auxiliary protrusion to slide the second fitting detection terminal case toward the first fitting detection terminal and subsequently the rear protrusion butts against the case-side protrusion to slide the second fitting detection terminal case toward the first fitting detection terminal.

(2) According to another embodiment of the invention, a connector comprises:

a second terminal housing for housing a plurality of second connecting terminals aligned;

a plurality of insulating members aligned and housed in the second terminal housing;

a laminated structure that a plurality of first connecting terminals and the plurality of second connecting terminals are alternately arranged so that one surface of the plurality of first connecting terminals faces one surface of the plurality of second connecting terminals to form pairs and to form a plurality of contact points sandwiched between the plurality of insulating members when the second terminal housing is fitted to a first terminal housing that is a housing to be fitted to the second terminal housing and houses the plurality of first connecting terminals aligned;

a connecting member for collectively fixing and electrically connecting the plurality of first connecting terminals and the plurality of second connecting terminals at each contact point by rotating a cam in a tightening direction and thereby pressing each contact point;

a second fitting detection terminal provided on the second terminal housing so as to be slidable along a fitting direction of the two terminal housings; and a slide means that makes the second fitting detection terminal slide in accordance with the rotation of the cam and electrically connects the first fitting detection terminal provided on the first terminal housing to the second fitting detection terminal when fitting the two terminals housings and then rotating the cam in the tightening direction.

(3) According to another embodiment of the invention, a wire harness comprises:

a plurality of cables;

a plurality of second connecting terminals to be connected to the plurality of cables;

a second terminal housing for housing the plurality of second connecting terminals aligned;

a plurality of insulating members aligned and housed in the second terminal housing;

a laminated structure that a plurality of first connecting terminals and the plurality of second connecting terminals are alternately arranged so that one surface of the plurality of first connecting terminals faces one surface of the plurality of second connecting terminals to form pairs and to form a plurality of contact points sandwiched between the plurality of insulating members when the second terminal housing is fitted to a first terminal housing that is a housing to be fitted to the second terminal housing and houses the plurality of first connecting terminals aligned;

a connecting member for collectively fixing and electrically connecting the plurality of first connecting terminals and the plurality of second connecting terminals at each contact point by rotating a cam in a tightening direction and thereby pressing each contact point;

a second fitting detection terminal provided on the second terminal housing so as to be slidable along a fitting direction of the two terminal housings; and a slide means that makes the second fitting detection terminal slide in accordance with the rotation of the cam and electrically connects the first fitting detection terminal provided on the first terminal housing to the second fitting detection terminal when fitting the two terminals housings and then rotating the cam in the tightening direction.

Effects of the Invention

According to one embodiment of the invention, a laminated-type connector can be provide that can detect the fitting of terminal housings without impairing the workability and the safety of connection work, as well as a wire harness using the connector.

BRIEF DESCRIPTION OF THE DRAWINGS

Next, the present invention will be explained in more detail in conjunction with appended drawings, wherein:

FIGS. 12A to 12D are diagrams illustrating a connecting member of the second connector portion of FIGS. 6A and 6B, wherein FIG. 12A is a perspective view, FIG. 12B is a cross sectional view, FIG. 12C is a perspective view showing a cam and FIG. 12D is a perspective view showing a bolt;

DETAILED DESCRIPTION OF THE PREFERRED EMBODIMENTS

An embodiment of the invention will be described below in conjunction with the appended drawings.

Figure 1:
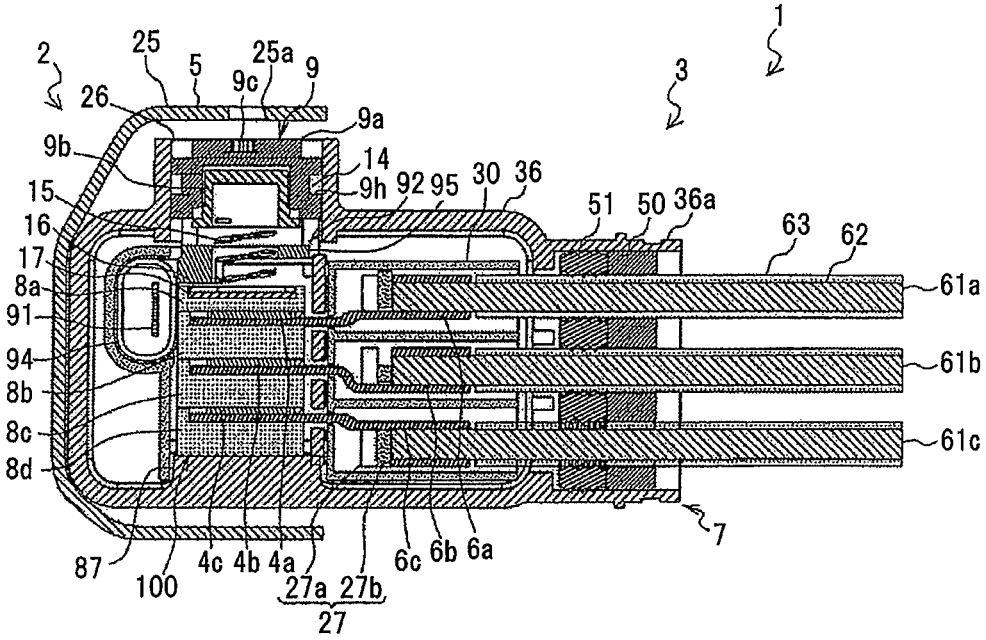
FIG. 1 is a cross sectional view showing a connector in the present embodiment.
Figure 2A:
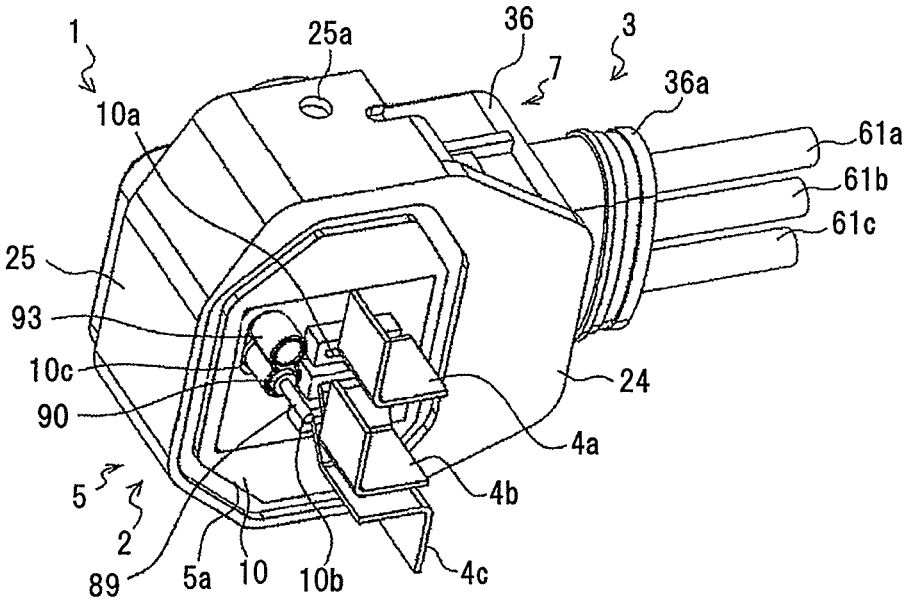
FIGS. 2A and 2B are perspective views thereof.
Figure 2B:
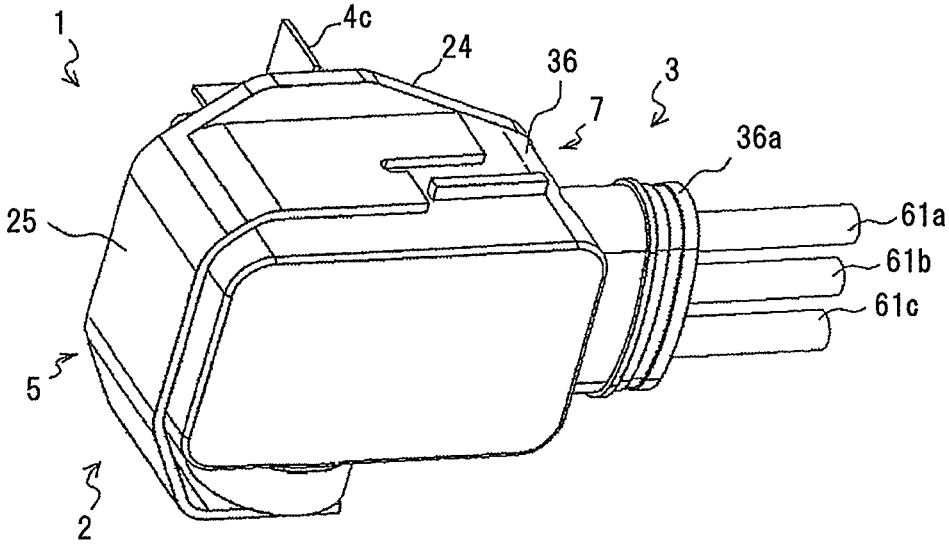
Figure 3A:
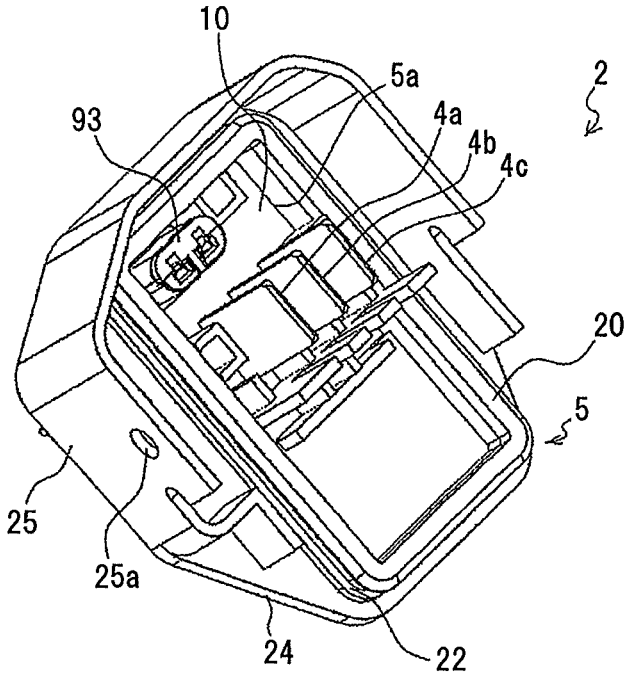
FIGS. 3A and 3B are perspective views showing a first connector portion of the connector of FIG. 1.
Figure 3B:
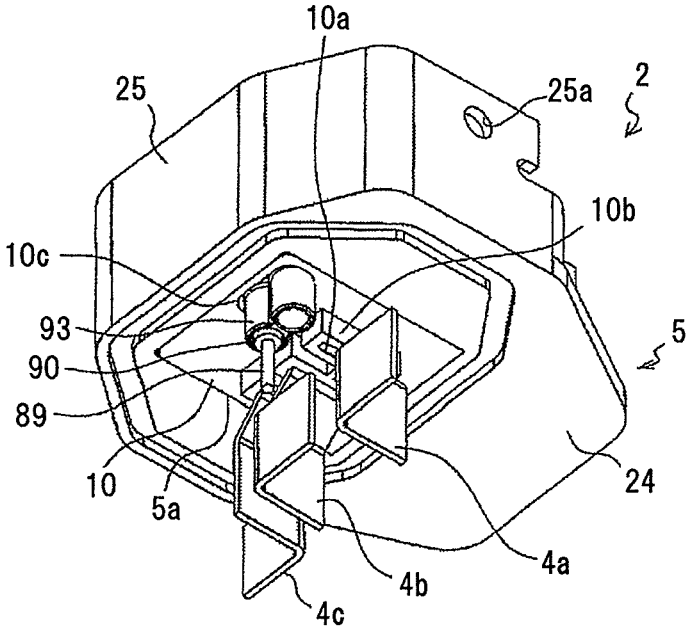

FIGS. 1 to 2B are diagrams illustrating a connector in the present embodiment, wherein FIG. 1 is a cross sectional view and FIGS. 2A and 2B are perspective views.

As shown in FIGS. 1 to 2B, a connector 1 in the present embodiment is composed of a first connector portion 2 and a second connector portion 3, and plural power lines are connected at a time by fitting the connector portions 2 and 3 together.

More specifically, the connector 1 is provided with the first connector portion 2 having a first terminal housing (male terminal housing) 5 housing plural (three) aligned first connecting terminals (male terminals) 4*a* to 4*c*, the second connector portion 3 having a second terminal housing (female terminal housing) 7 housing plural (three) aligned second connecting terminals (female terminals) 6*a* to 6*c*, and plural (four) insulating members 8*a* to 8*d* aligned and housed in the second terminal housing 7 for insulating the second connecting terminals 6*a* to 6*c* from each other.

The connector 1 is configured that, inside the first terminal housing 5 of the first connector portion 2 and the second terminal housing 7 of the second connector portion 3 which are fitted to each other, the first connecting terminals 4*a* to 4*c* and the second connecting terminals 6*a* to 6*c* are alternately arranged to form a laminated structure in which surfaces of the plural first connecting terminals 4*a* to 4*c* on one side face surfaces of the plural second connecting terminals 6*a* to 6*c* on one side to form respective pairs (a pair of the first connecting terminal 4*a* and the second connecting terminal 6*a*, that of the first connecting terminal 4*b* and the second connecting terminal 6*b*, and that of the first connecting terminal 4*c* and the second connecting terminal 6*c*) and to form plural contact points therebetween, and each contact point is sandwiched by two of the insulating members 8*a* to 8*d*.

In the connector 1, the first connector portion 2 is attached to a shielding case of a device such as inverter or motor and the externally exposed first connecting terminals 4*a* to 4*c* are electrically connected to the power lines of the device. Cables 61*a* to 61*c* are connected to the second connector portion 3, and are respectively electrically connected to the power lines of the device by connecting the first connector portion 2 to the second connector portion 3. The wire harness of the present embodiment is the cables 61*a* to 61*c* with the connector 1 (the second connector portion 3) provided at an end portion thereof.

The connector 1 is configured that the two terminal housings 5 and 7 are fitted so that a length direction of the first connecting terminals 4*a* to 4*c* crosses that of the second connecting terminals 6*a* to 6*c*. In the present embodiment, the connector 1 is configured that the two terminal housings 5 and 7 are fitted so that the length direction of the first connecting terminals 4*a* to 4*c* is orthogonal to that of the second connecting terminals 6*a* to 6*c*. Note that, in the connector 1, the length direction of the first connecting terminals 4*a* to 4*c* coincides with a fitting direction of the two terminal housings 5 and 7 and the length direction of the second connecting terminals 6*a* to 6*c* coincides with an extending direction of the cables 61*a* to 61*c*. Therefore, in the other words, the fitting direction of the two terminal housings 5 and 7 is orthogonal to the extending direction of the cables 61*a* to 61*c*.

It should be noted that, although a so-called L-shaped connector 1 in which the fitting direction of the two terminal housings 5 and 7 is orthogonal to the extending direction of the cables 61*a* to 61*c* will be described in the present embodiment, the invention is also applicable to a so-called straight connector in which the fitting direction of the two terminal housings 5 and 7 coincides with the extending direction of the cables 61*a* to 61*c*.

Each configuration of the connector portions 2 and 3 will be described in detail below.

First Connector Portion

Firstly, the first connector portion 2 will be described.

As shown in FIGS. 1 to 5, the first connector portion 2 is provided mainly with the first connecting terminals 4*a* to 4*c*, the first terminal housing 5 and a first inner housing 10.

Electricity of different voltage and/or current is transmitted to each of the first connecting terminals 4*a* to 4*c*. For example, the present embodiment assumes the use of a three-phase AC power line between a motor and an inverter, and alternate current having a phase difference of 120° is transmitted to each of the first connecting terminals 4*a* to 4*c*. Each of the first connecting terminals 4*a* to 4*c* should be formed of a highly conductive metal such as silver, copper or aluminum to reduce transmission loss, etc., in the connector 1. In addition, each of the first connecting terminals 4*a* to 4*c* has little flexibility.

For shielding performance, heat dissipation and weight saving of the connector 1, the first terminal housing 5 is preferably formed of light metal having high electrical and thermal conductivity such as aluminum, but may be formed of resin, etc. In the present embodiment, the first terminal housing 5 is formed of aluminum.

The first inner housing 10 is formed of an insulating resin (e.g., PPS (polyphenylene sulfide) resin, PPA (polyphthalamide) resin, PA (polyamide) resin, PBT (polybutylene terephthalate) and epoxy-based resin), etc.

The first connecting terminals 4*a* to 4*c* are respectively inserted into through-holes 10*a* formed on the first inner housing 10 and are then fixed. The first inner housing 10 is attached to the first terminal housing 5 so as to cover a terminal-attaching hole 5*a* formed on the first terminal housing 5, and the first connecting terminals 4*a* to 4*c* are thereby fixed to the first terminal housing 5 via the first inner housing 10 and are held in the first terminal housing 5 in the state of being aligned at predetermined intervals. Protruding portions 10*b* are provided on the first inner housing 10 so as to protrude outward from an rim of the through-holes 10*a*. This increases a contact area of the first inner housing 10 with the first connecting terminals 4*a* to 4*c* and it is thus possible to firmly hold the first connecting terminals 4*a* to 4*c*.

In addition, a first fitting detection terminal case-attaching hole 10*c* for attaching a below-described first fitting detection terminal case 93 is formed on the first inner housing 10.

The first terminal housing 5 is composed of a hollow cylindrical body 20 having a substantially rectangular horizontal cross-section and a lid portion 24 which is provided integrally with the cylindrical body 20 so as to cover one of openings of the cylindrical body 20 and has the terminal-attaching hole 5*a* formed thereon. The lid portion 24 is a flange-shaped portion to be in contact with a surface of the shielding case when the first connector portion 2 is attached to the shielding case of the device.

In the present embodiment, a protective wall 25 is formed so as to protrude forward in the fitting direction (toward the second connector portion 3) from an edge of the flange-shaped lid portion 24. A tool hole 25*a* is formed on the protective wall 25 to pass through a tool which is used for rotating a cam 9*a* of a blow-described connecting member 9.

The cylindrical body 20 is housed in the second terminal housing 7 when the two terminal housings 5 and 7 are fitted to each other. A groove 22 is formed on the outer periphery of the cylindrical body 20 along a circumferential direction and a packing (not shown) such as O-ring is placed in the groove 22 to make watertight between the second terminal housing 7 and the cylindrical body 20 when the two terminal housings 5 and 7 are fitted to each other. At an end portion of the cylindrical body 20 opposite to the lid portion 24, an edge on the outer peripheral side is formed in a tapered shape in light of fitting properties to the second terminal housing 7.

In the first terminal housing 5, the first connecting terminals 4*a* to 4*c* are arranged so as to be aligned in the thickness direction thereof.

Figure 4:
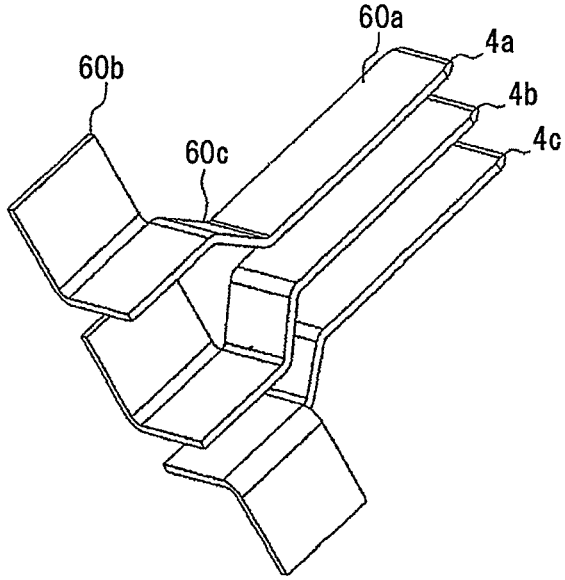
FIG. 4 is a perspective view showing first connecting terminals of the first connector portion of FIGS. 3A and 3B.
Figure 5:
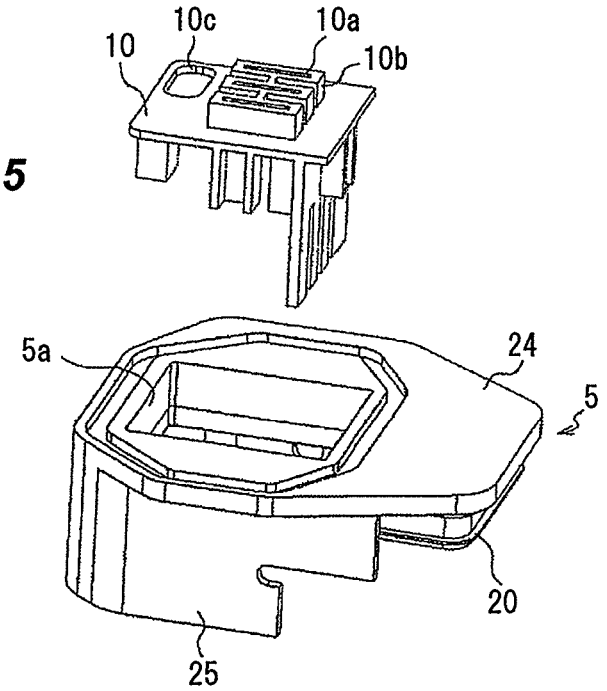
FIG. 5 is a perspective view showing a first terminal housing and a first inner housing of the first connector portion of FIGS. 3A and 3B.
Figure 6A:
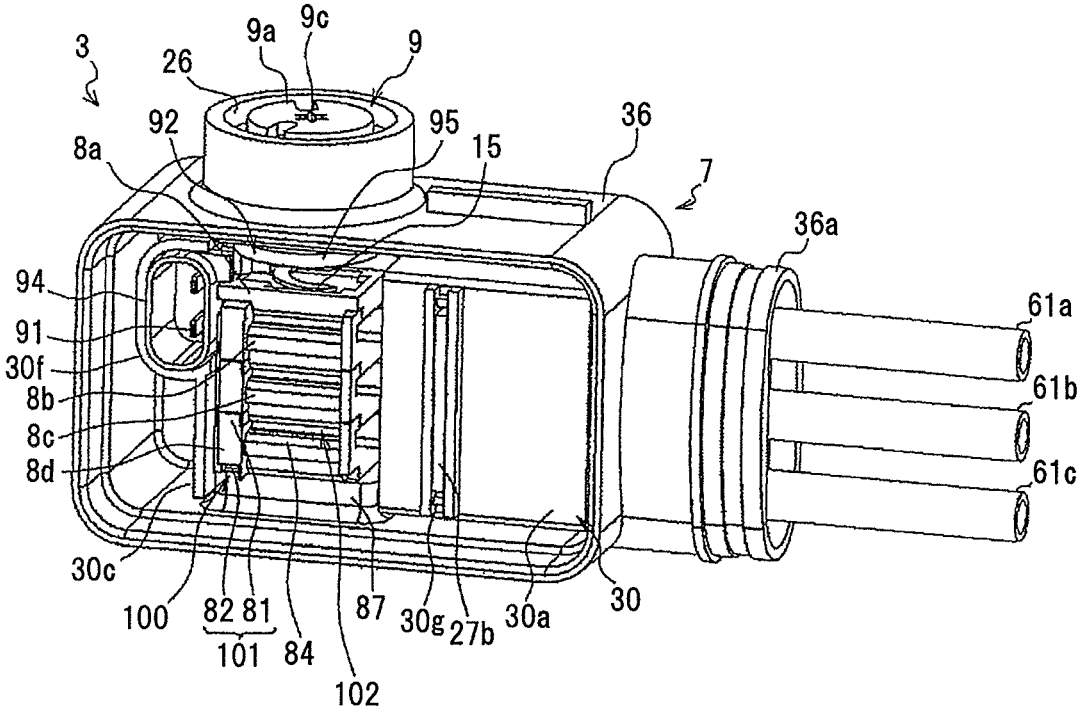
FIGS. 6A and 6B are perspective views showing a second connector portion of the connector of FIG. 1.
Figure 6B:
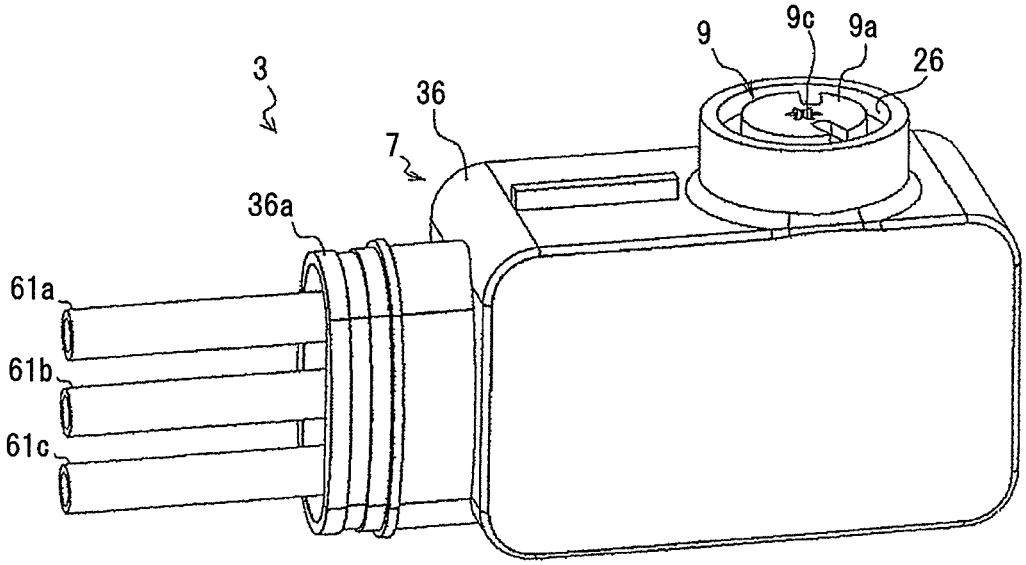

As shown in FIG. 4, each of the first connecting terminals 4*a* to 4*c* is configured such that an inclined portion 60*c* connects a base end portion of a plate-like member 60*a* to an L-shaped portion 60*b* formed in an L-shape as viewed from the fitting direction. The L-shaped portion 60*b* is provided so that one of two sides is parallel to a surface of the plate-like member 60*a* and is connected to the base end portion of the plate-like member 60*a* by the inclined portion 60*c* which is inclined with respect to the surface of the plate-like member 60*a*. Note that, the shape of the first connecting terminals 4*a* to 4*c* at a portion exposed to the outside from the first terminal housing 5 is not limited thereto and can be appropriately changed according to requirements on the device side. The tip portions of the first connecting terminals 4*a* to 4*c* are chamfered (or rounded) for easy insertion into a below-described insulating member assembly 100.

Second Connector Portion

Next, the second connector portion 3 will be described.

As shown in FIGS. 1 to 2B and 6A to 7B, the second connector portion 3 holds, inside thereof, three second connecting terminals 6*a* to 6*c* aligned at predetermined intervals, and is provided with the second terminal housing 7 housing the three aligned second connecting terminals 6*a* to 6*c*, plural insulating members 8*a* to 8*d* in a substantially rectangular parallelepiped shape which are provided in the second terminal housing 7 for insulating the second connecting terminals 6*a* to 6*c* from each other, and a connecting member 9 for collectively fixing and electrically connecting the plural first connecting terminals 4*a* to 4*c* to the plural second connecting terminals 6*a* to 6*c* at respective contact points by pressing the adjacent insulating member 8*a*.

The cables 61*a* to 61*c* are respectively connected to edges of the second connecting terminals 6*a* to 6*c* on one side. The cables 61*a* to 61*c* are each composed of a conductor 62 and an insulation layer 63 formed on the outer periphery thereof. The conductor 62 having a cross-sectional area of 20 $mm^2$ is used in the present embodiment.

Each of the second connecting terminals 6*a* to 6*c* should be formed of a highly conductive metal such as silver, copper or aluminum to reduce transmission loss, etc., in the connector 1. In addition, each of the second connecting terminals 6*a* to 6*c* has little flexibility.

Figure 8:
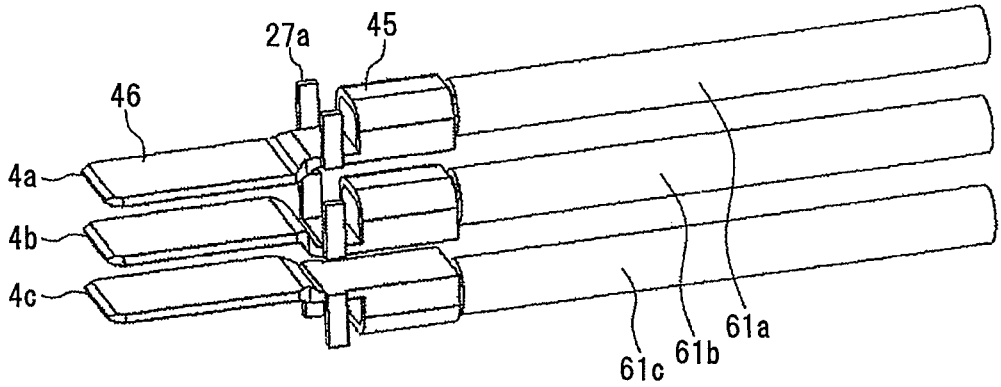
FIG. 8 is a perspective view showing second connecting terminals of the second connector portion and cables of FIGS. 6A and 6B.

As shown in FIG. 8, each of the second connecting terminals 6*a* to 6*c* has a crimping portion 45 for crimping the conductor 62 exposed at a tip portion of each of the cables 61*a* to 61*c* and a plate-like member 46 integrally formed with the crimping portion 45, and is formed in a clamp shape by bending the plate-like member 46 at the base end portion (a connecting portion with the crimping portion 45) into an S-shape. Protrusions 27*a* are formed on the plate-like member 46 so as to protrude upward (downward) from both widthwise edges at the base end portion of the plate-like member 46. The protrusions 27*a* constitute a below described slip-off suppression mechanism 27. The tip portions of the second connecting terminals 6*a* to 6*c* are chamfered (or rounded) for easy insertion into the insulating members 8*a* to 8*d*.

As shown in FIGS. 6A to 7B, a second inner housing 30, which is constructed from a resin molded article and has a multi-cylindrical shape (a shape formed of contiguous plural cylinders), holds the cables 61*a* to 61*c* so as to be aligned at predetermined intervals. The second connecting terminals 6*a* to 6*c* are fixed to the second terminal housing 7 via the cables 61*a* to 61*c* and the second inner housing 30. At this time, the second connecting terminals 6*a* to 6*c* are positioned and held respectively under (on the opposite side to the connecting member 9) the first connecting terminals 4*a* to 4*c* (i.e., connection targets) which respectively face and are paired with the second connecting terminals 6*a* to 6*c* when the first connector portion 2 is fitted to the second connector portion 3.

The second inner housing 30 is formed of an insulating resin (e.g., PPS (polyphenylene sulfide) resin, PPA (polyphthalamide) resin, PA (polyamide) resin, PBT (polybutylene terephthalate) and epoxy-based resin), etc., to prevent short circuit by insulating the second connecting terminals 6*a* to 6*c* from each other. The second inner housing 30 allows the second connecting terminals 6*a* to 6*c* to be held at respective predetermined positions even when each of the cables 61*a* to 61*c* respectively connected to the second connecting terminals 6*a* to 6*c* is very flexible. In other words, since a cable excellent in flexibility can be used as the cables 61*a* to 61*c* in the present embodiment, it is possible to improve the wiring flexibility for laying the cables 61*a* to 61*c*.

Figure 9A:
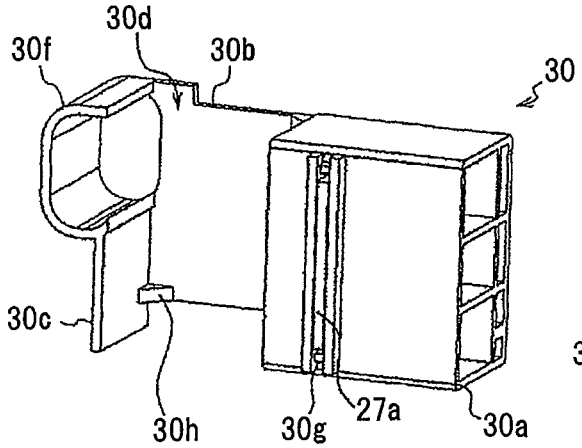
FIGS. 9A and 9B are perspective views showing the second inner housing of the second connector portion of FIGS. 6A and 6B.
Figure 9B:
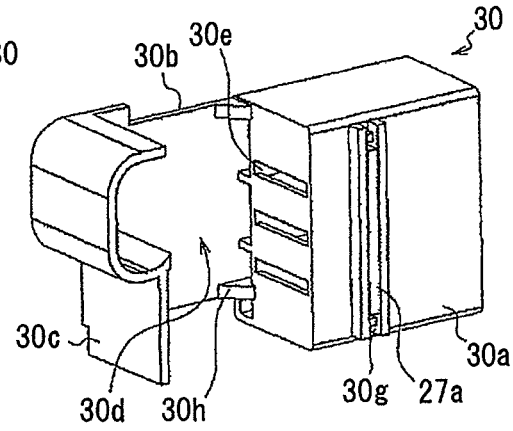
Figure 10A:
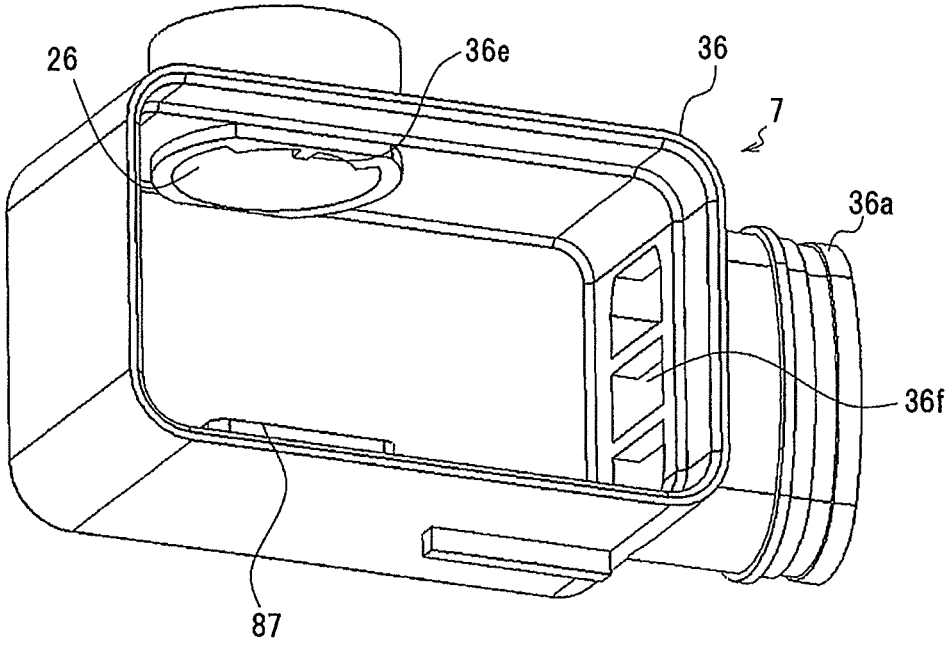
FIGS. 10A and 10B are perspective views showing the second terminal housing of the second connector portion of FIGS. 6A and 6B.
Figure 10B:
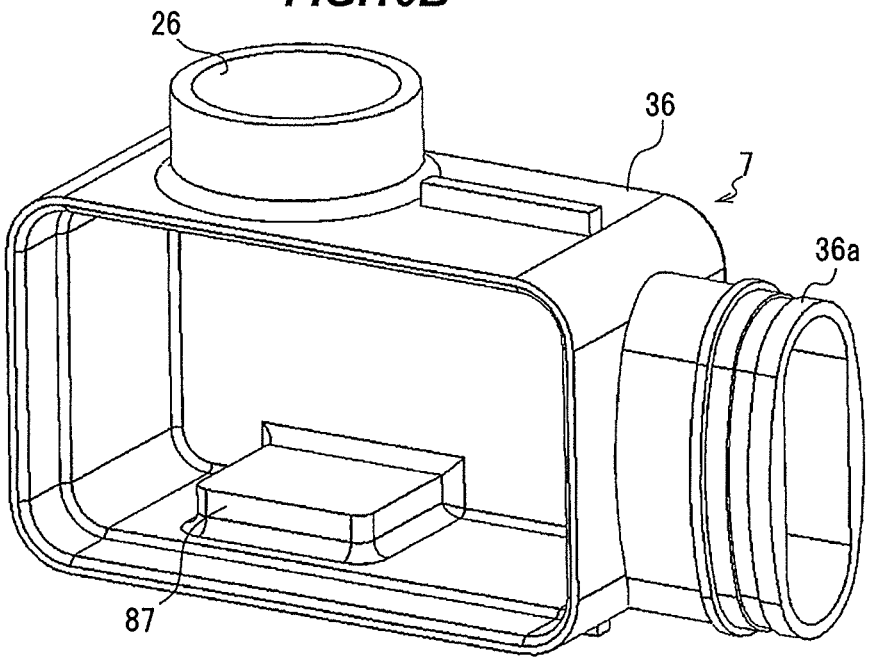

As shown in FIG. 9, the second inner housing 30 is formed in a multi-cylindrical shape composed of three contiguous square cylinders each opened on one side, has a main body 30*a* formed in a rectangular parallelepiped shape as a whole, a plate-like parallel portion 30*b* extending from a side edge portion of the main body 30*a* in an insertion direction of the cables 61*a* to 61*c* and a plate-like vertical portion 30*c* orthogonally extending from the front edge of the parallel portion 30*b*, and is configured that the insulating members 8*a* to 8*d* are housed in a space 30*d* which is surrounded by the parallel portion 30*b*, the vertical portion 30*c* and a surface of the main body 30*a* on the front side in the insertion direction of the cables 61*a* to 61*c*.

Reinforcing ribs 30*h* are respectively formed at a corner formed at an intersection of the parallel portion 30*b* and the surface of the main body 30*a* on the front side in the insertion direction of the cables 61*a* to 61*c* and at a corner formed at an intersection of the vertical portion 30*c* and the parallel portion 30*b*. In addition, a case housing portion 30*f* for slidably housing a below-described second fitting detection terminal case 94 is formed on the vertical portion 30*c*. The case housing portion 30*f* is formed in a cylindrical shape of which lateral side is partially opened (on the main body 30*a* side).

Terminal insertion holes 30*e* for inserting the second connecting terminals 6*a* to 6*c* (for exposing the tip portions of the second connecting terminals 6*a* to 6*c* from the main body 30*a*) are formed on the surface of the main body 30*a* on the front side in the insertion direction of the cables 61*a* to 61*c*.

Although the second connecting terminals 6*a* to 6*c* in the present embodiment are inserted into the terminal insertion holes 30*e* so that the second connecting terminals 6*a* to 6*c* are directly held by the second inner housing 30 and are positioned, it is not limited thereto. It is also possible to position the second connecting terminals 6*a* to 6*c* by holding the cables 61*a* to 61*c* (in more detail, by holding the end portion of the cables 61*a* to 61*c* at a position close to the second connecting terminals 6*a* to 6*c*). Note that, it is preferable that the terminal insertion hole 30*e* be formed slightly larger than the second connecting terminals 6*a* to 6*c* so that the second connecting terminals 6*a* to 6*c* which are deformed by being pressed by the connecting member 9 do not come into contact with the second inner housing 30.

The second connector portion 3 is provided with the slip-off suppression mechanism 27 so that the cables 61*a* to 61*c* are not pulled out from the second inner housing 30 even when the cables 61*a* to 61*c* are pulled. The slip-off suppression mechanism 27 is composed of the protrusions 27*a* formed at the respective base end portions of the second connecting terminals 6*a* to 6*c* (in the vicinity of the cables 61*a* to 61*c*; in the present embodiment, at an end portion of the plate-like member 46 on the crimping portion 45 side), and an inner plate 27*b* for locking the protrusions 27*a* to restrict the protrusions 27*a* from moving backward (toward the cables 61*a* to 61*c*) (see FIG. 1). An inner plate insertion hole 30*g* is formed on a side surface of the main body 30*a* (a side surface facing the opening of the second terminal housing 7) and the inner plate 27*b* is inserted therethrough so as to protrude into each of the multiple cylinders after the cables 61*a* to 61*c* and the second connecting terminals 6*a* to 6*c* are inserted into the main body 30*a* of the second inner housing 30, thereby providing the inner plate 27*b*. Note that, the structure of the inner plate 27*b* is not limited in the present embodiment and any structure is acceptable as long as the protrusions 27*a* of the second connecting terminals 6*a* to 6*c* are locked and movement of the protrusions 27*a* is restricted.

As shown in FIGS. 1, 6A, 6B, 10A and 10B, the second terminal housing 7 is constructed from a hollow cylindrical body 36 opening on one side and having a substantially rectangular cross section, and is configured that the first terminal housing 5 is inserted and fitted to the opening of the cylindrical body 36. A cylindrical cable insertion portion 36*a* for inserting the cables 61*a* to 61*c* is formed integrally on the lateral side of the cylindrical body 36 (the side surface on the right side in FIGS. 10A and 10B). A hollow portion in the cylindrical body 36 is in communication with that in the cable insertion portion 36*a* via three rectangular insertion holes 36*f* for passing the cables 61*a* to 61*c*, and the cables 61*a* to 61*c* pass through the hollow portion in the cable insertion portion 36*a* and the insertion holes 36*f* and are then inserted into the cylindrical body 36. The insertion direction of the first terminal housing 5 is orthogonal to the insertion direction of the cables 61*a* to 61*c*.

A braided shield may be wound around the cables 61*a* to 61*c* led out of the second terminal housing 7 in order to improve the shielding performance even though it is not illustrated. For example, the braided shield is electrically connected to the first terminal housing 5 via the second terminal housing 7 and is kept at ground potential.

Furthermore, the outer periphery of the cable insertion portion 36*a* from where the cables 61*a* to 61*c* are led out is covered by a rubber boot for preventing water from entering into the cable insertion portion 36*a* or the cylindrical body 36, even though it is not illustrated.

Meanwhile, a connecting member insertion hole 26 for inserting the connecting member 9 is formed on an upper portion of the cylindrical body 36 (on the upper side in FIG. 10). The second terminal housing 7 is formed to have a cylindrical shape (hollow cylinder) at the rim of the connecting member insertion hole 26.

A rectangular parallelepiped-shaped pedestal 87 protruding toward the connecting member insertion hole 26 is provided on an inner peripheral surface of the cylindrical body 36 at a position facing the connecting member insertion hole 26. In the connector 1, the laminated structure is sandwiched and held between the connecting member 9 and the pedestal 87, and a pressing force is applied to the laminated structure by pressing the connecting member 9 toward the pedestal 87 and is thereby applied to each contact point.

Figure 11:
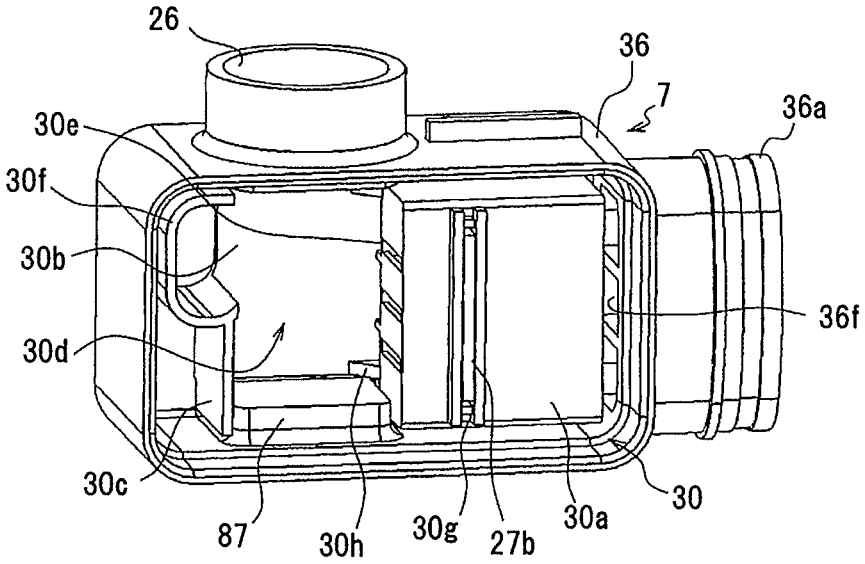
FIG. 11 is a perspective view showing the state in which the second inner housing of FIGS. 9A and 9B is attached to the second terminal housing of FIGS. 10A and 10B.
Figure 12A:
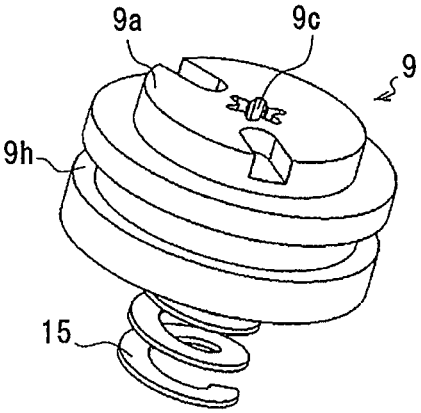
Figure 12B:
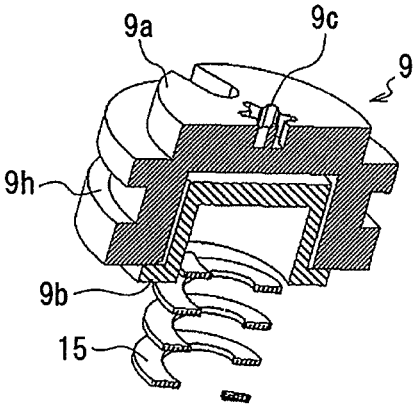
Figure 12C:
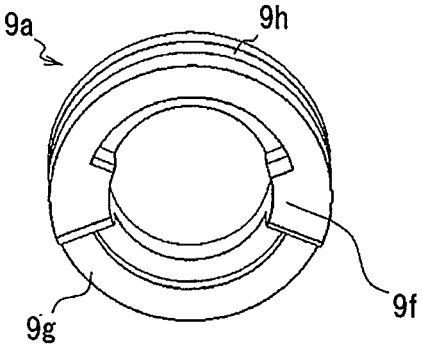
Figure 12D:
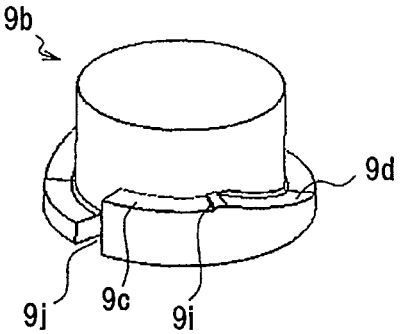
Figure 13A:
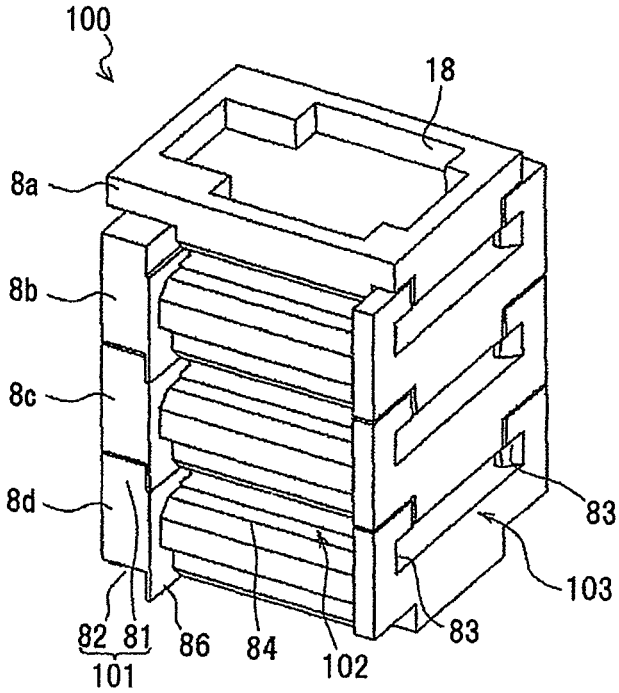
FIG. 13A is a perspective view showing an insulating member assembly of the second connector portion of FIGS. 6A and 6B.
Figure 13B:
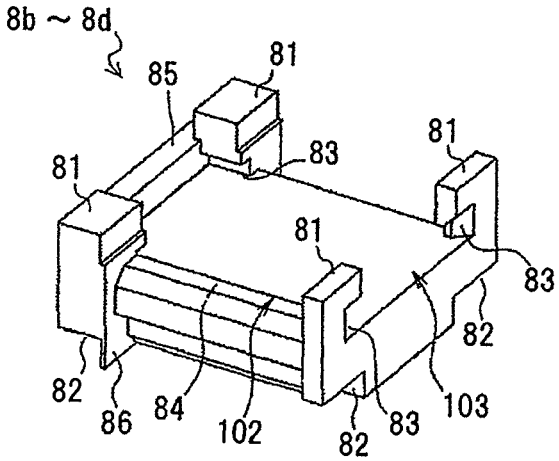
FIGS. 13B and 13C are perspective views showing a first insulating member of the insulating member assembly.
Figure 13C:
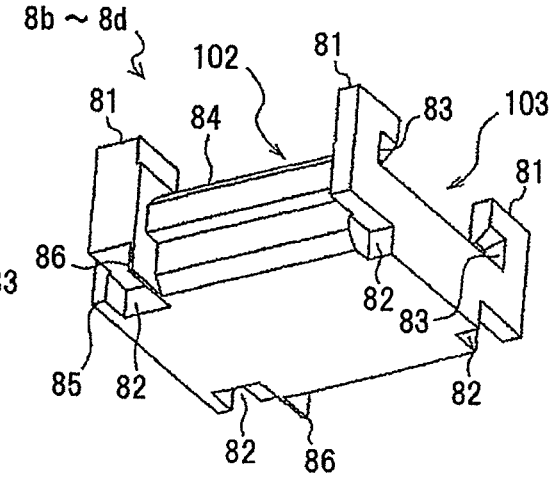

As shown in FIG. 11, the second inner housing 30 is arranged so that the main body 30*a* is arranged next to the pedestal 87 on the cable insertion portion 36*a* side, the parallel portion 30*b* extends over the pedestal 87 and the vertical portion 30*c* is located on a side of the pedestal 87 opposite to the cable insertion portion 36*a*.

For shielding performance, heat dissipation and weight saving of the connector 1, the second terminal housing 7 is preferably formed of light metal having high electrical and thermal conductivity such as aluminum, but may be formed of resin, etc. In the present embodiment, the cylindrical body 36 is formed of aluminum.

Figure 7A:
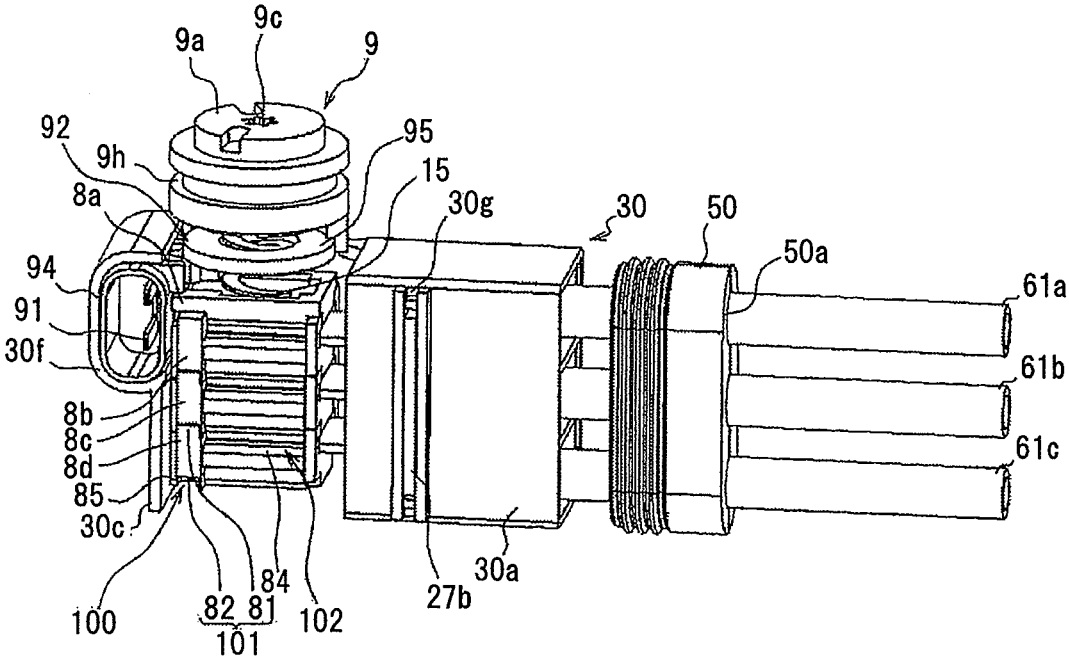
FIG. 7A is a perspective view showing the second connector portion of FIGS. 6A and 6B where the second terminal housing is removed.
Figure 7B:
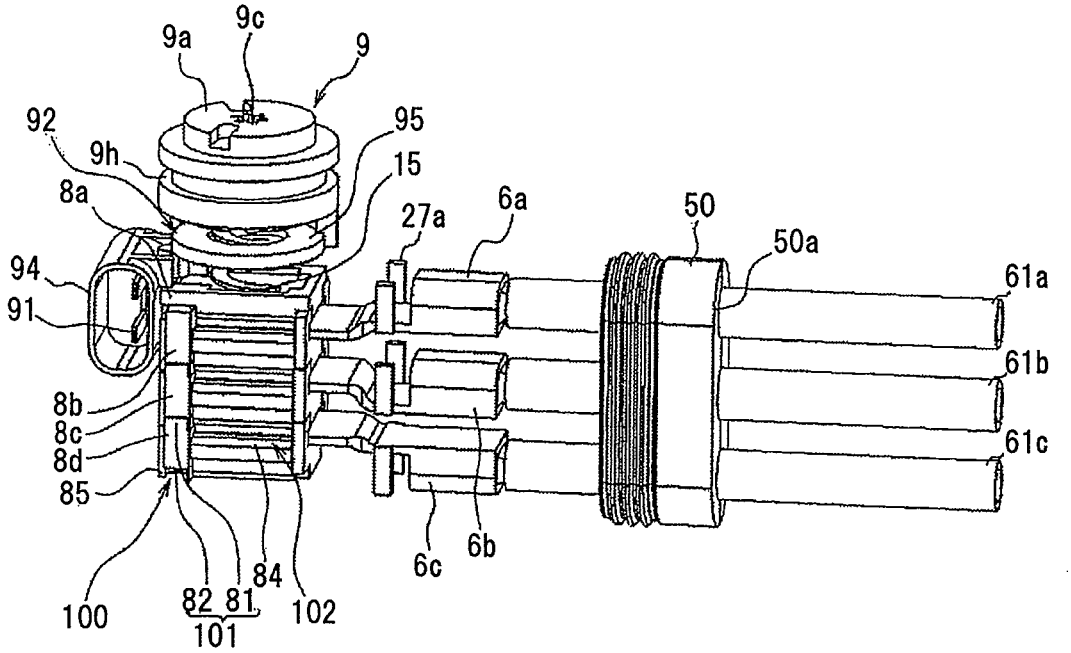
FIG. 7B is a perspective view showing the second connector portion where the second inner housing is further removed.

In addition, in the second connector portion 3, the cables 61*a* to 61*c* are sandwiched and held by a tail plate 50 having a two-divided structure provided with holes 50*a* for inserting the cables 61*a* to 61*c* as shown in FIGS. 7A and 7B and a wire seal (waterproof packing) 51 is provided next to the tail plate 50 on the second connecting terminals 6*a* to 6*c* side, which keeps water from entering the second terminal housing 7 along the cables 61*a* to 61*c*. The wire seal 51 is arranged so as to be sandwiched between the tail plate 50 and the wall in the periphery of the insertion holes 36*f* (see FIG. 10A).

As shown in FIGS. 1 and 6A to 7B, among the plural insulating members 8*a* to 8*d*, the plural first insulating members 8*b* to 8*d* are aligned and housed in the second terminal housing 7 and are also provided integrally with the respective surfaces of the plural second connecting terminals 6*a* to 6*c* on another side (surfaces opposite to the surfaces connected to the first connecting terminals 4*a* to 4*c*), and a second insulating member 8*a* is provided so as to face the surface of the outermost first connecting terminal 4*a* (the uppermost side in FIGS. 1 and 6A to 7B) on another side (a surface opposite to the surface connected to the second connecting terminal 6*a*) when the plural first connecting terminals 4*a* to 4*c* and the plural second connecting terminals 6*a* to 6*c* form a laminated state.

In the connector 1 of the present embodiment, the insulating member assembly 100, which has an insulating member restricting means 101 for restricting movement of the insulating members 8*a* to 8*d* in a direction perpendicular to a lamination direction of the laminated structure, is formed by connecting the insulating members 8*a* to 8*d* to each other. The insulating member restricting means 101 is configured to restrict movement of the insulating members 8*a* to 8*d* in the x-y plane of the orthogonal coordinate system in which the lamination direction of the laminated structure is the z-axis.

Holes for inserting the connecting terminals 4*a* to 4*c* and 6*a* to 6*c* to be inserted orthogonal to each other, i.e., first terminal insertion holes 102 for inserting the first connecting terminals 4*a* to 4*c* and second terminal insertion holes 103 for inserting the second connecting terminals 6*a* to 6*c*, are provided on the insulating member assembly 100. The first terminal insertion hole 102 is formed between adjacent two of the insulating members 8*a* to 8*d* and the second terminal insertion hole 103 is formed on each of the first insulating members 8*b* to 8*d*. The insulating member assembly 100 will be described in detail later.

As shown in FIG. 12, the connecting member 9 is composed of the cam 9*a* and a bolt 9*b*. The cam 9*a* is formed in a cylindrical shape opening only on the lower side and has an irregular-shaped hole 9*c* (in the present embodiment, a hole having a hexalobular shape) formed on an upper surface so that a tool such as wrench can be fitted to rotate the cam 9*a*. On the side surface of the cam 9*a*, a groove 9*h* is formed to house a packing 14 (see FIG. 1) such as O-ring which is provided to keep water from entering the second terminal housing 7. The lower portion of the cam 9*a* (including a position for forming the groove 9*h*) has an enlarged diameter having a flange shape. Although it is not illustrated, it is configured that, when inserting the cam 9*a* into the connecting member insertion hole 26 of the second terminal housing 7 and fitting and fixing a ring-shaped fixing member into a groove formed on the inner peripheral surface of the connecting member insertion hole 26, the flange portion which comes into contact with the fixing member restricts movement of the cam 9*a* toward the outside and the cam 9*a* is thus rotatably held between the second terminal housing 7 and the fixing member.

An upper portion of the bolt 9*b* is inserted into the hollow portion in the cam 9*a*. Raised portions 9*f* protruding toward the hollow portion are formed on the inner wall (inner peripheral surface) of the hollow portion in the cam 9*a* at positions facing each other. In addition, a cut-out portion 9*g* is formed by cutting off a circumferential portion of the sidewall of the cam 9*a* at a lower end (an end portion on the second insulating member 8*a* side). The cut-out portion 9*g* is to be engaged with an engaging wall 95*c* of a below-described slide ring 95.

The bolt 9*b* is formed in a cylindrical shape opening only on the lower side and has a flange-like enlarged diameter at the lower portion thereof. A notch 9*j* formed on the flange portion is slidably engaged with a linear protrusion 36*e* (see FIG. 10A) formed on the second terminal housing 7 so as to extend vertically, which allows the bolt 9*b* to slide in a vertical direction without rotating together with the cam 9*a*.

Slopes 9*d* are formed on the upper surface of the flange portion (i.e., a stepped portion) of the bolt 9*b*. The two slopes 9*d* are formed at 180° rotationally symmetric positions around a rotational axis of the cam 9*a* so as to correspond to the two raised portions 9*f*. A flat portion 9*e* is formed at the top of the slope 9*d* and a level difference 9*i* is formed between the flat portion 9*e* and the slope 9*d* to restrict the raised portion 9*f* located on the flat portion 9*e* from moving and thus to prevent unintentional rotation of the cam 9*a*.

The connecting member 9 is configured that, when the cam 9*a* is rotated in the tightening direction from the release position, the raised portions 9*f* of the cam 9*a* come into contact with the slopes 9*d* of the bolt 9*b* and moves the bolt 9*b* toward the second insulating member 8*a* and the second insulating member 8*a* is thereby pressed. Due to such a configuration, the cam 9*a* to be rotated by a worker is always located at a certain position and does not move vertically, which improves workability. Hereinafter, a rotation direction of the cam 9*a* for applying a pressing force to each contact point will be referred to as "the tightening direction" and a rotation direction of the cam 9*a* for releasing a pressing force applied to each contact point will be referred to as "the direction opposite to the tightening direction".

The cam 9*a* and the bolt 9*b* which are formed of a metal such as SUS, iron or copper alloy are used. The cam 9*a* and the bolt 9*b* may be formed of a resin but are preferably formed of metal from the viewpoint of strength.

Meanwhile, an elastic member 15 for applying a predetermined pressing force to the second insulating member 8*a* is provided between the bolt 9*b* of the connecting member 9 and the upper surface of the second insulating member 8*a* immediately therebelow. In the present embodiment, the upper portion of the elastic member 15 is housed in the hollow portion in the bolt 9*b*. This is an idea to reduce a distance between the bolt 9*b* and the second insulating member 8*a* and to downsize the connector 1 even when the elastic member 15 is long to some extent. The elastic member 15 is constructed from, e.g., a spring formed of metal (e.g., SUS, etc.). Note that, the elastic member 15 is regarded as a portion of the connecting member 9 in the present embodiment.

A concave portion 16 (see FIGS. 7A and 7B) covering (housing) a lower portion of the elastic member 15 is formed on the upper surface of the second insulating member 8*a* with which the lower portion of the elastic member 15 is in contact, and a receiving member 17 formed of metal (e.g., SUS, etc.) for preventing the second insulating member 8*a* formed of an insulating resin from being damaged by receiving the elastic member 15 is provided on a bottom of the concave portion 16 (i.e., a seat portion with which the lower portion of the elastic member 15 is in contact).

The receiving member 17 is to prevent damage on the second insulating member 8*a* by dispersing stress applied from the elastic member 15 to the upper surface of the second insulating member 8*a*. Therefore, a contact area between the receiving member 17 and the second insulating member 8*a* is preferably as large as possible. The receiving member 17 having a shape in contact throughout the entire bottom surface of the concave portion 16 is provided in the present embodiment in order to increase the contact area between the receiving member 17 and the second insulating member 8*a*.

Connection Between First Connector Portion and Second Connector Portion

When the two terminal housings 5 and 7 are fitted to each other, the first connecting terminals 4*a* to 4*c* are respectively inserted into the first terminal insertion holes 102 and are then inserted into respective gaps between the second connecting terminals 6*a* to 6*c* to be respectively paired therewith and the insulating members 8*a* to 8*d*. This insertion provides a laminated structure in which the surfaces of the plural first connecting terminals 4*a* to 4*c* on the one side face the surfaces of the plural second connecting terminals 6*a* to 6*c* on the one side to form the respective pairs, and the first connecting terminals 4*a* to 4*c*, the second connecting terminals 6*a* to 6*c* and the insulating members 8*a* to 8*d* are alternately arranged, i.e., the insulating members 8*a* to 8*d* are arranged so as to sandwich the pairs of the first connecting terminals 4*a* to 4*c* and the second connecting terminals 6*a* to 6*c*.

At this time, in the second connector portion 3, since the first insulating members 8*b* to 8*d* are respectively provided at the tips of the second connecting terminals 6*a* to 6*c* aligned and held at predetermined intervals, each gap between the insulating members 8*b* to 8*d* can be kept without additionally providing a retaining jig for keeping respective gaps between the insulating members 8*b* to 8*d*. This makes easy to insert the first connecting terminals 4*a* to 4*c* into the respective gaps between the second connecting terminals 6*a* to 6*c* to be respectively paired therewith and the insulating members 8*a* to 8*d*. In other words, the insertion and extraction properties of the first connecting terminals 4*a* to 4*c* are not degraded. In addition, it is very effective in that it is possible to realize further downsizing as compared to the conventional art since it is not necessary to provide a retaining jig for keeping the gaps between the insulating members 8*b* to 8*d*.

Meanwhile, a contact point between the first connecting terminal 4*a* and the second connecting terminal 6*a* is sandwiched between the second insulating member 8*a* and the first insulating member 8*b* attached to the second connecting terminal 6*a* constituting the contact point. Likewise, a contact point between the first connecting terminal 4*b* (or 4*c*) and the second connecting terminal 6*b* (or 6*c*) is sandwiched between the first insulating member 8*c* (or 8*d*) attached to the second connecting terminal 6*b* (or 6*c*) constituting the contact point and the first insulating member 8*b* (or 8*c*) attached to the second connecting terminal 6*a* (or 6*b*) constituting another contact point.

When the cam 9*a* of the connecting member 9 is turned by a tool such as wrench in this state and presses the bolt 9*b* downward, the second insulating member 8*a*, the first insulating member 8*b*, the first insulating member 8*c* and the first insulating member 8*d* are pressed in this order by the elastic member 15, a pressing force is applied to each contact point by any two of the insulating members 8*a* to 8*d* sandwiching and pressing each contact point to cause contact in a state that contact points are insulated from each other. At this time, the first connecting terminals 4*a* to 4*c* and the second connecting terminals 6*a* to 6*c* are bent in some degree due to pressure from the insulating members 8*a* to 8*d* and respectively make contact in a large area. This makes strong contact and fixation of each contact point even under the environment in which vibration occurs, such as in a vehicle.

A tool for rotating the cam 9*a* is fitted to the irregular-shaped hole 9*c* through the tool hole 25*a* on the protective wall 25. The connector 1 is configured that the irregular-shaped hole 9*c* is out of alignment with the tool hole 25*a* and the cam 9*a* cannot be rotated by the tool when the two terminal housings 5 and 7 are not tightly fitted to each other, and that a pressing force is applied to each contact point only when the two terminal housings 5 and 7 are firmly fitted to each other.

Insulating Member Assembly

Next, the insulating member assembly 100 will be described in detail.

As shown in FIGS. 1, 7A, 7B and 13A to 13C, the insulating member assembly 100 is formed by sequentially connecting the insulating members 8*a* to 8*d* in the lamination direction. That is, the insulating member assembly 100 is formed by respectively connecting the second insulating member 8*a* to the first insulating member 8*b*, the first insulating member 8*b* to the first insulating member 8*c*, and the first insulating member 8*c* to the first insulating member 8*d*.

In the insulating member assembly 100, the insulating member restricting means 101 restricts the insulating members 8*a* to 8*d* from moving in the lamination direction and the vertical direction when the insulating members 8*a* to 8*d* are connected to each other. In the insulating member assembly 100, the insulating members 8*a* to 8*d* are connected to be relatively movable in the lamination direction in order to transfer a pressing force of the connecting member 9 to each contact point.

The insulating member restricting means 101 is provided with plural connecting pieces 81 and plural connecting grooves 82. The connecting pieces 81 are provided one of the two insulating members 8*a*, 8*b*, 8*c* or 8*d* adjacent in the lamination direction and protrude toward the other adjacent insulating member 8*a*, 8*b*, 8*c* or 8*d*. The connecting grooves 82 are provided on the other adjacent insulating member 8*a*, 8*b*, 8*c* or 8*d* so as to correspond to the plural connecting pieces 81 and receive the connecting pieces 81 so as to be slidable in the lamination direction.

In the present embodiment, the insulating members 8*a* to 8*d* are formed in a substantially rectangular shape as viewed from the lamination direction thereof and one or both of the connecting piece 81 and the connecting groove 82 are formed at least at two of four corners of the insulating members 8*a* to 8*d*. Here, the case where one or both of the connecting piece 81 and the connecting groove 82 are formed at four corners of the insulating members 8*a* to 8*d* will be described.

In insulating member assembly 100, the connecting pieces 81 are integrally formed on the first insulating members 8*b* to 8*d* so as to extend from four corners in the width direction of the first insulating members 8*b* to 8*d* toward the opposite insulating members 8*a* to 8*c* (toward the second insulating member 8*a* from the first insulating member 8*b*, toward the first insulating member 8*b* from the first insulating member 8*c* and toward the first insulating member 8*c* from the first insulating member 8*d*) with interposition of the second connecting terminals 6*a* to 6*c* to which the first insulating members 8*b* to 8*d* are attached.

In addition, the connecting grooves 82 for receiving the connecting pieces 81 so as to be slidable in the lamination direction are respectively formed on the both side surfaces of the insulating members 8*a* to 8*c* opposite to the first insulating members 8*b* to 8*d* (facing with interposition of the second connecting terminals 6*a* to 6*c* to which the first insulating members 8*b* to 8*d* are attached). In the present embodiment, the plural first insulating members 8*b* to 8*d* are formed to have the same shape and the connecting grooves 82 are also formed on the first insulating members 8*d* which is located at the outermost position. In addition, in the present embodiment, the connecting piece 81 and the connecting groove 82 are formed in a substantially rectangular shape as viewed from the lamination direction. Forming the plural first insulating members 8*b* to 8*d* into the same shape allows the number of components and the cost to be reduced.

The insulating members 8*a* to 8*d* are connected to be relatively movable in the lamination direction by respectively receiving the connecting pieces 81 of the first insulating member 8*b* in the connecting grooves 82 of the second insulating member 8*a*, the connecting pieces 81 of the first insulating member 8*c* in the connecting grooves 82 of the first insulating member 8*b* and the connecting pieces 81 of the first insulating member 8*d* in the connecting grooves 82 of the first insulating member 8*c*, and the insulating member assembly 100 is thereby formed.

In addition, the insulating member assembly 100 is configured that, when the insulating members 8*a* to 8*d* are connected (laminated), the front edge (top edge) of the connecting piece 81 is stopped by the upper surface of the connecting groove 82 and each gap between the insulating members 8*a* to 8*d* is controlled so as not to be narrower than a predetermined gap (the minimum lamination gap).

The minimum lamination gap is adjusted to be slightly smaller than the total thickness (contact point thickness) of the first connecting terminal 4*a*, 4*b* or 4*c* and the second connecting terminal 6*a*, 6*b* or 6*c* which constitute a contact point. It is because a pressing force from the connecting member 9 is not transferred to the contact point if the minimum lamination gap is greater than the contact point thickness and if, on the other hand, the minimum lamination gap is too small, the positional misalignment of the insulating members 8*a* to 8*d* become too large when the second connecting terminals 6*a* to 6*c* are deformed for some reasons and this causes defects such as deterioration in fitting properties. The minimum lamination gap can be adjusted by adjusting a difference in length in the lamination direction between the connecting piece 81 and the connecting groove 82 (for example, the minimum lamination gap is increased with increasing the length of the connecting piece 81 with respect to the connecting groove 82).

Figure 14A:
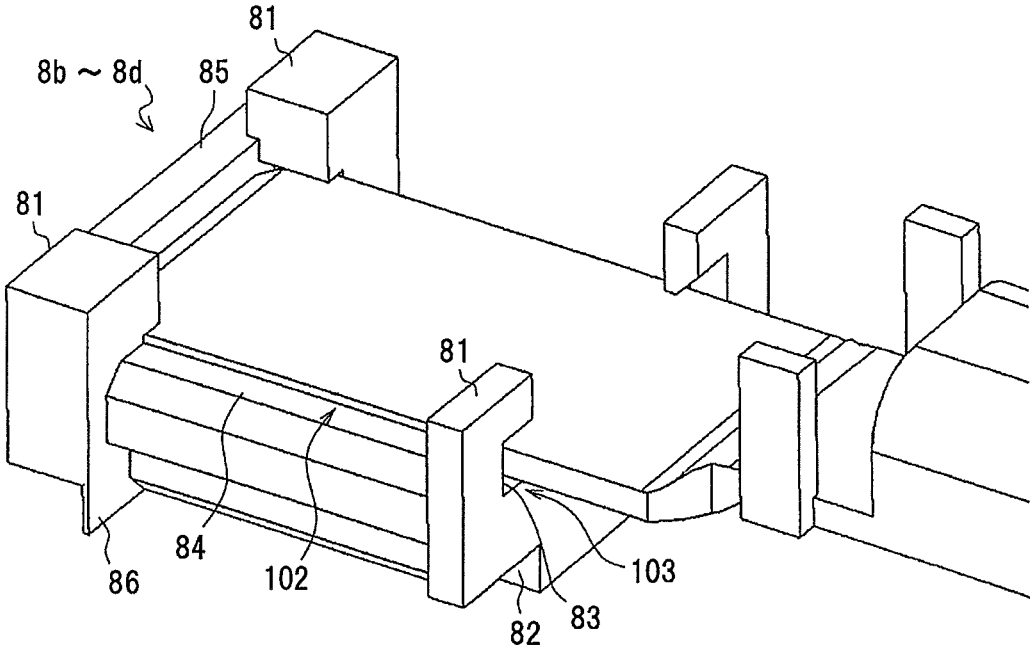
FIG. 14A is a perspective view showing the first insulating member and a second connecting terminal.

As shown in FIG. 14A, the four connecting pieces 81 of the first insulating members 8*b* to 8*d* are formed in a substantially F-shape or a substantially mirror-reversed Γ-shape as viewed from the length direction of the second connecting terminals 6*a* to 6*c*, and a squared U-shaped fitting groove 83 opening inward is formed on each connecting piece 81. The first insulating members 8*b* to 8*d* are locked and fixed to the second connecting terminals 6*a* to 6*c* by inserting the second connecting terminals 6*a* to 6*c* into the fitting grooves 83. In other words, the connecting piece 81 has a function of connecting the insulating members 8*a* to 8*d* to each other as well as a function of locking the second connecting terminals 6*a* to 6*c*, and the fitting grooves 83 of the connecting pieces 81 serve as the second terminal insertion hole 103.

Figure 14B:
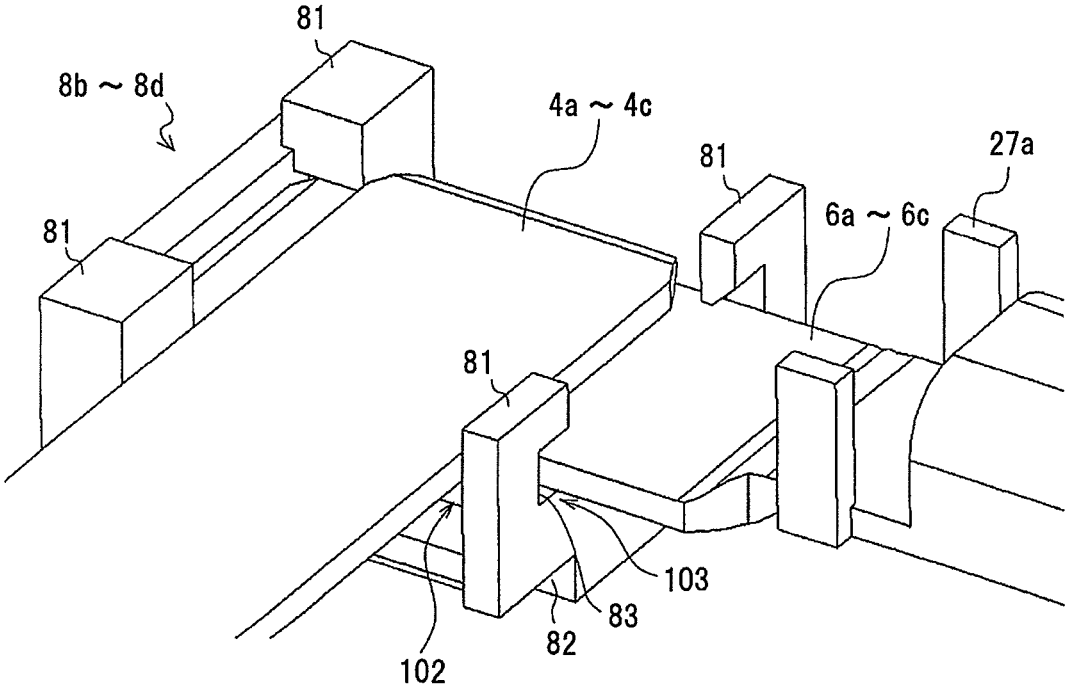
FIG. 14B is a perspective view showing the first insulating member, the second connecting terminal and the first connecting terminal.

On the other hand, as shown in FIG. 1 and FIG. 14B, the first connecting terminals 4*a* to 4*c* are inserted between the connecting pieces 81 which are formed at positions facing the opening of the second terminal housing 7 (on a side from which the first connecting terminals 4*a* to 4*c* are inserted) when the two terminal housings 5 and 7 are fitted to each other. In other words, the connecting pieces 81 formed at the positions facing the opening of the second terminal housing 7 also have a function of guiding and positioning the tip portions of the first connecting terminals 4*a* to 4*c*, and an opening sandwiched by the two connecting pieces 81 between the second connecting terminal 6*a*, 6*b* or 6*c* and the insulating member 8*a*, 8*b* or 8*c* serves as the first terminal insertion hole 102.

In the present embodiment, as shown in FIGS. 14A and 14B, a collision-prevention wall 84 is integrally formed on each of the plural first insulating members 8*b* to 8*d*. The collision-prevention wall 84 covers an end face of the second connecting terminal 6*a*, 6*b* or 6*c* on the side from which the first connecting terminals 4*a* to 4*c* are inserted, in order to prevent collision between the two connecting terminals 4*a*, 4*b* or 4*c* and 6*a*, 6*b* or 6*c* at the time of inserting the first connecting terminal 4*a*, 4*b* or 4*c* between the second connecting terminal 6*a*, 6*b* or 6*c* and the insulating member 8*a*, 8*b* or 8*c*. An edge of each collision-prevention wall 84 is chamfered (or rounded) to facilitate insertion of the first connecting terminals 4*a* to 4*c*. A portion of each of the insulating members 8*a* to 8*c* at a position facing the collision-prevention wall 84 (i.e., an edge of the each of the insulating members 8*a* to 8*c* on the opposite side to the connecting member 9 and on the side from which the first connecting terminals 4*a* to 4*c* are inserted) is also chamfered (or rounded) in the same manner. An edge of the connecting piece 81 on the first terminal insertion hole 102 side may be also chamfered or rounded to further facilitate insertion of the first connecting terminals 4*a* to 4*c* even though it is not performed in the present embodiment. The collision-prevention wall 84 is formed so that the upper surface thereof is flush with the upper surface of the second connecting terminal 6*a*, 6*b* or 6*c*.

Since the first insulating members 8*b* to 8*d* is attached to the second connecting terminals 6*a* to 6*c*, the first insulating members 8*b* to 8*d* are held by the second terminal housing 7 via the second connecting terminals 6*a* to 6*c* and the second inner housing 30 and are positioned with respect to the first terminal housing 5. In the state that the first insulating members 8*b* to 8*d* are positioned with respect to the first terminal housing 5, a gap is formed between the front edge of the connecting piece 81 and the upper surface of the connecting groove 82 and the first insulating members 8*b* to 8*d* are relatively movable to each other in the lamination direction. At this time, the insulating members 8*a* to 8*d* are housed in the space 30*d* surrounded by the main body 30*a*, the parallel portion 30*b* and the vertical portion 30*c* of the second inner housing 30 (see FIGS. 9 and 11).

The fitting groove 83 is formed so that a width thereof in the lamination direction is slightly larger than the thickness of the second connecting terminals 6*a* to 6*c*. Thus, a gap (or clearance) is formed between the fitting groove 83 and the second connecting terminal 6*a*, 6*b* or 6*c* when the second connecting terminal 6*a*, 6*b* or 6*c* is fitted to the fitting groove 83. Accordingly, the first insulating members 8*b* to 8*d* are provided having looseness with respect to the second connecting terminals 6*a* to 6*c*. Since the first insulating members 8*b* to 8*d* are provided having looseness with respect to the second connecting terminals 6*a* to 6*c*, the first insulating members 8*b* to 8*d* can flexibly move even when the first insulating members 8*b* to 8*d* are slightly out of alignment. Therefore, deterioration in fitting properties such as hitting of the first connecting terminals 4*a* to 4*c* against the first insulating members 8*b* to 8*d* can be suppressed. In addition, forming the gaps (or clearances) between the fitting grooves 83 and the second connecting terminals 6*a* to 6*c* allows the second connecting terminals 6*a* to 6*c* to be easily fitted to the fitting grooves 83. Note that, although only the lateral edge of the fitting groove 83 is chamfered in the present embodiment in order to easily fit the second connecting terminal 6*a*, 6*b* or 6*c* into the fitting grooves 83, the upper and lower edges of the fitting groove 83 or an edge of the first insulating members 8*b* to 8*d* on the side from which the second connecting terminals 6*a* to 6*c* are inserted may be chamfered or rounded.

In addition, a connecting wall 85 is integrally formed on each of the first insulating members 8*b* to 8*d* so as to connect between the two connecting pieces 81 located opposite to the side from which the second connecting terminals 6*a* to 6*c* are inserted. The connecting wall 85 is provided parallel to the insertion direction of the first connecting terminals 4*a* to 4*c* so as to cover a side of the fitting groove 83 opposite to the side from which the second connecting terminals 6*a* to 6*c* are inserted, which improves mechanical strength of the connecting pieces 81. In addition, the tip portions of the second connecting terminals 6*a* to 6*c* hit against the connecting walls 85. Therefore, the connecting wall 85 serves to position the second connecting terminals 6*a* to 6*c* and to suppress excessive insertion thereof. Furthermore, the connecting wall 85 extends downward so as to cover a side of the connecting groove 82 opposite to the side from which the second connecting terminals 6*a* to 6*c* are inserted. This increases a contact area when the connecting piece 81 is inserted into the connecting groove 82. Thus, the connecting wall 85 also has a function of further stabilizing the connection between the first insulating members 8*b* to 8*d* to each other. Note that, the connecting wall 85 is formed at a height that does not hit the opposite insulating member 8*a*, 8*b* or 8*c* when each gap between the insulating members 8*a* to 8*d* is set to the minimum lamination gap.

Furthermore, as shown in FIG. 14B, the connecting wall 85 covers the lateral side of the first connecting terminal 4*a*, 4*b* or 4*c* and serves to increase a creepage distance between the contact points when the two terminal housings 5 and 7 are fitted and the first connecting terminals 4*a* to 4*c* are inserted. Such a configuration is effective especially when reducing the size of the insulating members 8*a* to 8*d* to downsize the connector 1. Note that, in the present embodiment, a connecting wall is not formed on a side of the insulating members 8*a* to 8*d* opposite to the side from which the first connecting terminals 4*a* to 4*c* are inserted since it is configured that the first connecting terminals 4*a* to 4*c* are inserted partway without covering the entire second connecting terminals 6*a* to 6*c* when the two terminal housings 5 and 7 are fitted and this increases the creepage distance between the contact points via the side of the insulating members 8*b* to 8*d* opposite to the side from which the first connecting terminals 4*a* to 4*c* are inserted, however, it is obviously possible to further form a connecting wall on the side of the insulating members 8*b* to 8*d* opposite to the side from which the first connecting terminals 4*a* to 4*c* are inserted.

In addition, in the present embodiment, a reinforcing wall 86 is provided so as to face the connecting wall 85 with the connecting groove 82 interposed therebetween and it is configured that sandwiching the connecting piece 81 inserted into the connecting groove 82 between the connecting wall 85 and the reinforcing wall 86 allows the connecting piece 81 to be held more firmly.

Although the connecting pieces 81 are formed on the first insulating members 8*b* to 8*d* and the connecting grooves 82 are formed on the opposite insulating members 8*a* to 8*c* in the present embodiment, it is obviously possible to reverse the positions of the connecting pieces 81 and the connecting grooves 82 in the insulating member assembly 100 (to form the connecting pieces 81 on the insulating members 8*a* to 8*c* and the connecting grooves 82 on the opposite insulating members 8*b* to 8*d*). In this case, however, it is not possible to form the fitting groove 83 on the connecting piece 81 and a mechanism for providing the first connecting terminals 4*a* to 4*c* needs to be additionally provided on the first insulating members 8*b* to 8*d*, which makes the structure of the first insulating members 8*b* to 8*d* complicated.

Fitting Detection Mechanism

Next, a fitting detection mechanism which is an essential part of the invention will be described.

The connector 1 is provided with a fitting detection mechanism for detecting the fitting of the two terminal housings 5 and 7. The fitting detection mechanism constitutes a part of a current interrupting device such as High Voltage Interlock Loop (HVIL).

The fitting detection mechanism is provided with a first fitting detection terminal 90 provided on one of the first terminal housing 5 and the second terminal housing 7, a second fitting detection terminal 91 provided on the other of the first terminal housing 5 and the second terminal housing 7 so as to be slidable along the fitting direction of the two terminal housings 5 and 7, and a slide means 92 which makes the second fitting detection terminal 91 slide in accordance with the rotation of the cam 9*a* and electrically connects the first fitting detection terminal 90 to the second fitting detection terminal 91 when fitting the two terminal housings 5 and 7 and then rotating the cam 9*a* in the tightening direction.

In the present embodiment, the first fitting detection terminal 90 is provided on the first terminal housing 5 and the second fitting detection terminal 91 and the slide means 92 are provided on the second terminal housing 7.

Figure 15A:
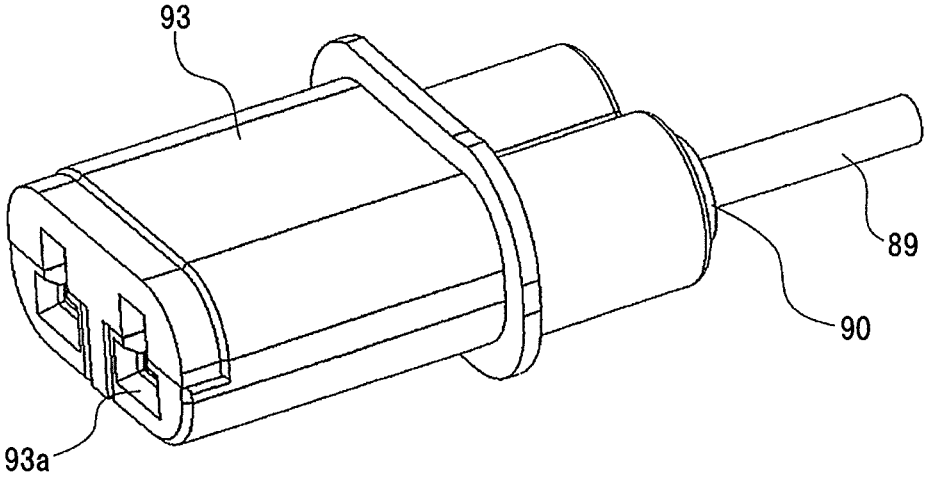
FIG. 15A is a perspective view showing a first fitting detection terminal case and a first fitting detection terminal.
Figure 15B:
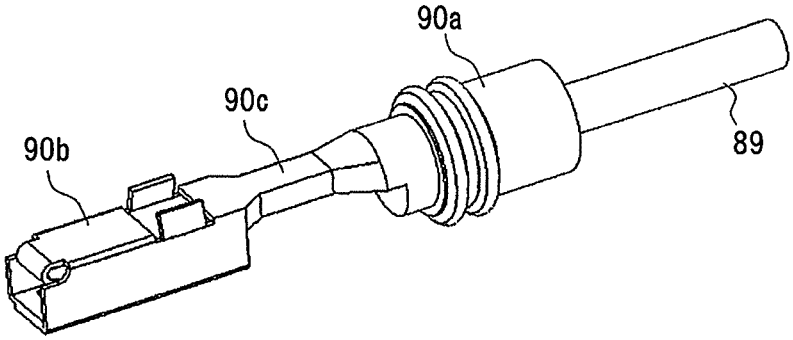
FIG. 15B is a perspective view showing the first fitting detection terminal.
Figure 16A:
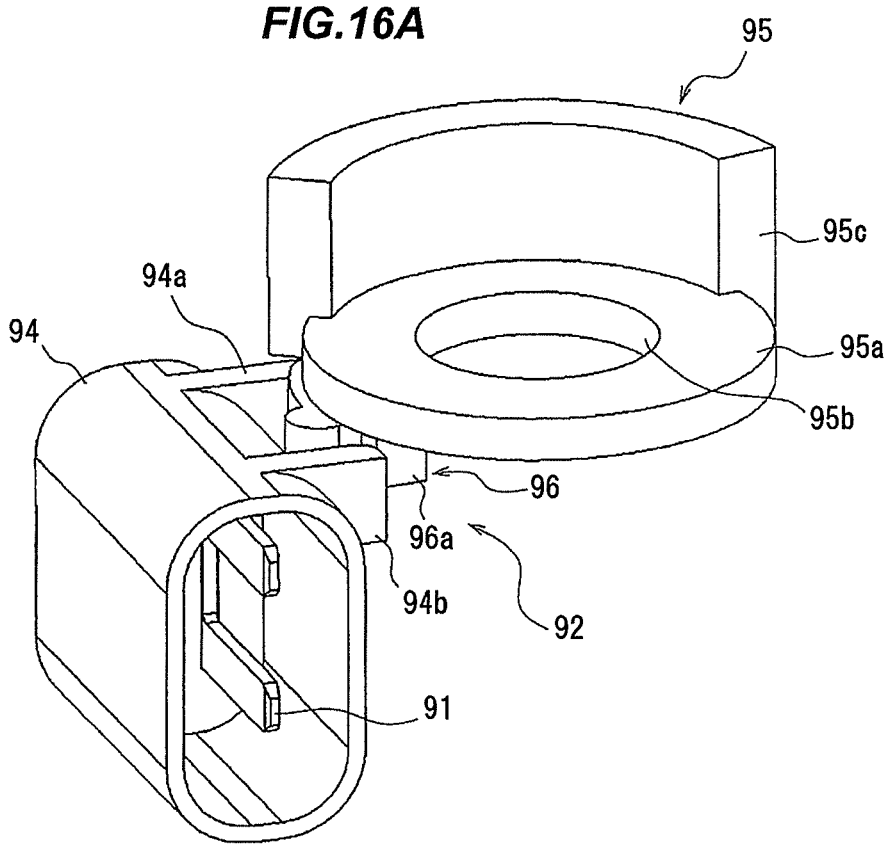
FIG. 16A is a perspective view showing a second fitting detection terminal case, a second fitting detection terminal and a slide ring.
Figure 16B:
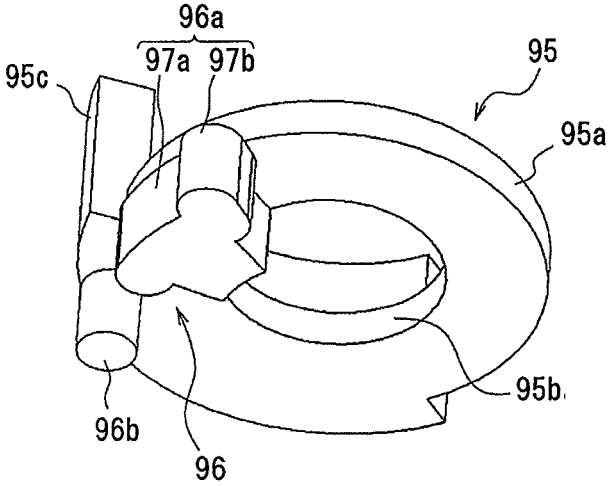
FIG. 16B is a perspective view showing the slide ring.
Figure 16C:
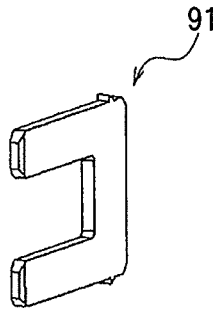
FIG. 16C is a perspective view showing the second fitting detection terminal.

As shown in FIG. 15, the first fitting detection terminal 90 is housed and held in the first fitting detection terminal case 93. The first fitting detection terminal case 93 is attached to the first fitting detection terminal case-attaching hole 10*c* of the first inner housing 10 and the first fitting detection terminal 90 is thereby fixed to the first terminal housing 5 via the first fitting detection terminal case 93 and the first inner housing 10.

The first fitting detection terminal 90 is composed of a crimping portion 90*a* for crimping and fixing a fitting detection cable 89, a terminal area 90*b* formed in a substantially square cylinder shape into which a tip portion of the second fitting detection terminal 91 is inserted, and a connecting portion 90*c* for connecting the crimping portion 90*a* to the terminal area 90*b*. A plate spring is provided inside the terminal area 90*b*. This plate spring presses the tip portion of the second fitting detection terminal 91 against the inner wall of the terminal area 90*b* to retain a contact point. Guide holes 93*a* for each guiding the tip portion of the second fitting detection terminal 91 into the terminal area 90*b* are formed at the front end portion of the first fitting detection terminal case 93. Edges at the rim of the guide hole 93*a* are chamfered to facilitate insertion of the second fitting detection terminal 91.

Two first fitting detection terminals 90 are aligned and held in the first fitting detection terminal case 93 although the illustration is omitted, and the fitting detection cables 89 extending from a non-illustrated fitting detection device are respectively connected to the both first fitting detection terminals 90.

The second fitting detection terminal 91 is housed and held in the second fitting detection terminal case 94. The second fitting detection terminal case 94 is formed in a cylindrical shape which opens on the front side in a sliding direction (on the front side in the fitting direction). The second fitting detection terminal 91 is formed in a substantially U-shape and is fixed inside the second fitting detection terminal case 94 so that the tip portions thereof face the opening. Edges at the tip portions of the second fitting detection terminal 91 are chamfered to facilitate insertion into the terminal area 90*b* of the first fitting detection terminal 90.

The slide means 92 has a case-side protrusion 94*a* provided on the second fitting detection terminal case 94 and a slide ring 95 rotating integrally with the cam 9*a*.

The slide ring 95 has a ring portion 95*a* rotating integrally with the cam 9*a* and a ring-side protrusion 96 coming in contact with the case-side protrusion 94*a* to slide the second fitting detection terminal case 94 when the ring portion 95*a* is rotated.

The ring portion 95*a* is formed in a disc shape and has a through-hole 95*b* formed at the middle portion to let the elastic member 15 pass through. In addition, an engaging wall 95*c* is formed on the ring portion 95*a* at a circumferential portion so as to protrude upward (toward the cam 9*a*) from the rim of the ring portion 95*a*. It is configured that the engaging wall 95*c* is engaged with the cut-out portion 9*g* of the cam 9*a* so that the cam 9*a* rotates integrally with the ring portion 95*a*.

The ring-side protrusion 96 is formed so as to protrude downward from the lower surface (opposite to the cam 9*a*) of the ring portion 95*a*. In the present embodiment, the ring-side protrusion 96 is composed of two protrusions, a front protrusion 96*a* formed along a circumferential direction of the ring portion 95*a* and a rear protrusion 96*b*.

The front protrusion 96*a* has an arc portion 97*a* formed in an arc shape along a circumferential direction of the ring portion 95*a* as viewed from the lower side and a protruding portion 97*b* protruding radially outward of the ring portion 95*a* at an end portion of the arc portion 97*a* opposite to the rear protrusion 96*b*. The arc portion 97*a* and the protruding portion 97*b* have rounded sidewalls. The rear protrusion 96*b* is formed in a column shape.

The case-side protrusion 94*a* is provided so as to protrude laterally (toward the slide ring 95) from the outer peripheral surface of the second fitting detection terminal case 94. In the present embodiment, a case-side auxiliary protrusion 94*b* is formed on the second fitting detection terminal case 94 on the front side in the sliding direction (on the front side in the fitting direction) with respect to the case-side protrusion 94*a* so as to protrude laterally from the outer peripheral surface of the second fitting detection terminal case 94.

The operation of the fitting detection mechanism will be described below in reference to FIGS. 17A to 18C. Note that, FIGS. 17A to 18C show a positional relation between the first fitting detection terminal case 93, the second fitting detection terminal case 94 and the slide ring 95 as viewed from the lower side of FIG. 1.

Figure 17A:
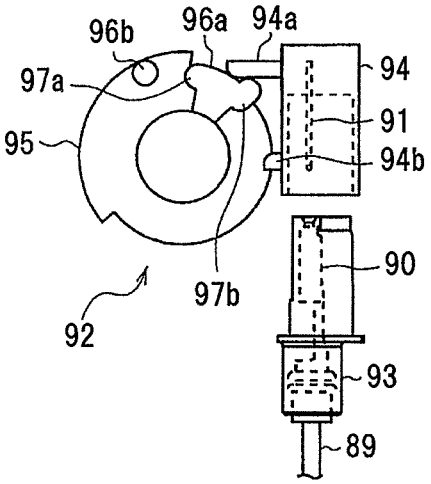
FIGS. 17A to 17E are explanatory diagrams illustrating operation of a fitting detection mechanism.

At the release position where the cam 9*a* rotated in the direction opposite to the tightening direction is located, the case-side protrusion 94*a* is pressed backward in the sliding direction (upward in FIG. 17A) by the protruding portion 97*b* of the front protrusion 96*a* as shown in FIG. 17A and the second fitting detection terminal case 94 is restricted from moving forward in the sliding direction (downward in FIG. 17A).

Figure 17B:
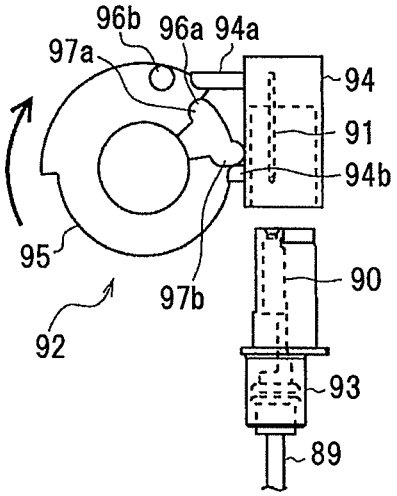

By rotating the cam 9*a* in the tightening direction from this state, the slide ring 95 is rotated and the protruding portion 97*b* of the front protrusion 96*a* comes into contact with the case-side auxiliary protrusion 94*b*, as shown in FIG. 17B. The second fitting detection terminal case 94 is not pushed forward in the sliding direction until the front protrusion 96*a* comes into contact with the case-side auxiliary protrusion 94*b*, while the bolt 9*b* is pressed down in accordance with the rotation of the cam 9*a* and a pressing force is applied to each contact point via the elastic member 15.

Figure 17C:
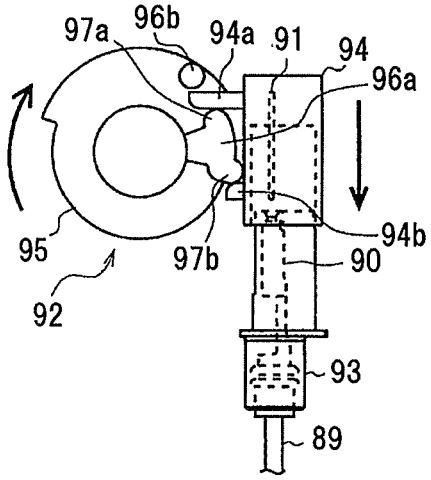

By further rotating the cam 9*a* in the tightening direction, the protruding portion 97*b* of the front protrusion 96*a* butts against the case-side auxiliary protrusion 94*b* as shown in FIG. 17C and the second fitting detection terminal case 94 slides forward in the sliding direction (toward the first fitting detection terminal 90) in accordance with the rotation of the slide ring 95.

Figure 17D:
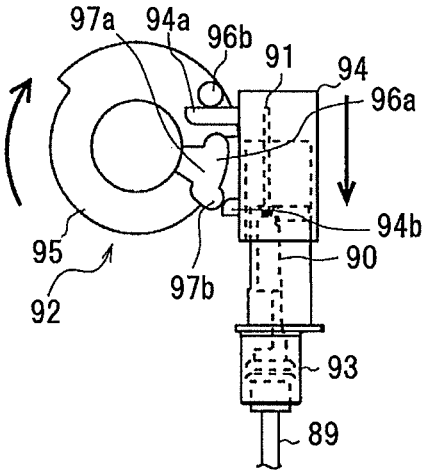

By further rotating the cam 9*a* in the tightening direction, the protruding portion 97*b* of the front protrusion 96*a* is disengaged from the case-side auxiliary protrusion 94*b* and the rear protrusion 96*b* comes into contact with the case-side protrusion 94*a*, as shown in FIG. 17D. In order to facilitate the disengagement of the front protrusion 96*a* at this time, an edge of the top end portion of the case-side auxiliary protrusion 94*b* on the rear side in the sliding direction (opposite to the first fitting detection terminal 90) is rounded.

Figure 17E:
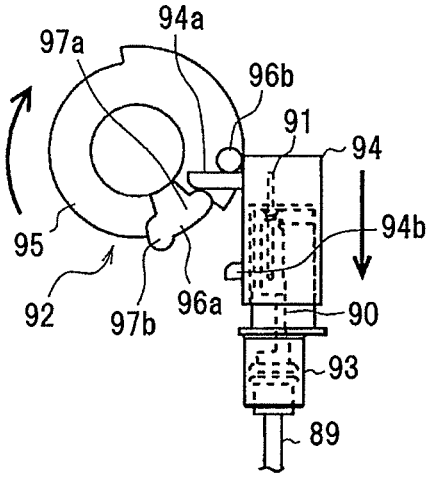

By further rotating the cam 9*a* in the tightening direction, the rear protrusion 96*b* butts against the case-side protrusion 94*a* as shown in FIG. 17E and the second fitting detection terminal case 94 slides forward in the sliding direction (toward the first fitting detection terminal 90) in accordance with the rotation of the slide ring 95.

As a result, the front end portion of the first fitting detection terminal case 93 is pushed into the second fitting detection terminal case 94 and the tip portion of the second fitting detection terminal 91 into the terminal area 90*b* of the first fitting detection terminal 90, and the first fitting detection terminal 90 is thereby electrically connected to the second fitting detection terminal 91.

In the present embodiment, both tip portions of the U-shaped second fitting detection terminal 91 are respectively pushed into the terminal areas 90*b* of the two first fitting detection terminals 90 housed in the first fitting detection terminal case 93 and the two first fitting detection terminals 90 are electrically connected to each other via the second fitting detection terminal 91. As a result, a loop circuit is formed from a fitting detection device to another fitting detection device via the fitting detection cable 89, the first fitting detection terminal 90, the second fitting detection terminal 91, another first fitting detection terminal 90 and another fitting detection cable 89. The fitting detection device is configured that, e.g., voltage is applied to end portions of the both fitting detection cables 89 extending from the fitting detection devices and whether the two terminal housings 5 and 7 are fitted or not is determined based on whether or not a current flowing through the loop circuit is not less than a preset threshold.

At the tightened position where the cam 9*a* rotated in the tightening direction is located, the case-side protrusion 94*a* is sandwiched between the front protrusion 96*a* and the rear protrusion 96*b* as shown in FIG. 17E and the second fitting detection terminal case 94 is restricted from moving in the sliding direction.

As such, in the present embodiment, the slide means 92 is configured to electrically connect the first fitting detection terminal 90 to the second fitting detection terminal 91 after a pressing force is applied to each contact point when fitting the two terminal housings 5 and 7 and then rotating the cam 9*a* in the tightening direction. Thus, it is possible to configure such that an electric current can flow through each contact point only after properly applying a pressing force to each contact point and it is thus possible to improve safety.

Note that, it is only necessary to provide the rear protrusion 96*b* and the case-side protrusion 94*a* at the very least from the viewpoint of sliding the second fitting detection terminal case 94 toward the first fitting detection terminal 90 but, in this case, it is not possible to sufficiently provide a moving distance of the second fitting detection terminal case 94 in the sliding direction unless the size of the slide ring 95 is increased. Due to the configuration of the present embodiment in which the front protrusion 96*a* butts against the case-side auxiliary protrusion 94*b* to slide the second fitting detection terminal case 94 toward the first fitting detection terminal 90 and the rear protrusion 96*b* subsequently butts against the case-side protrusion 94*a* to slide the second fitting detection terminal case 94 toward the first fitting detection terminal 90, it is possible to sufficiently provide the moving distance of the second fitting detection terminal case 94 in the sliding direction even when the slide ring 95 is small and this allows the size of the entire connector 1 to be reduced.

Figure 18A:
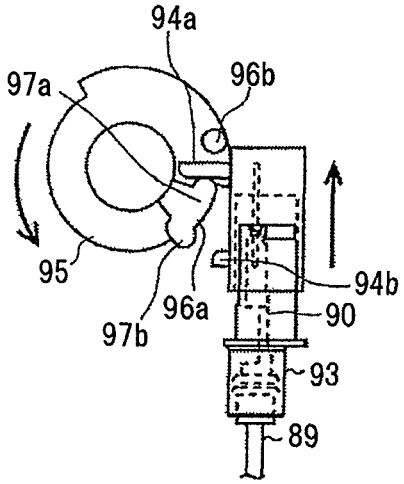
FIGS. 18A to 18C are explanatory diagrams illustrating operation of the fitting detection mechanism.
Figure 18B:
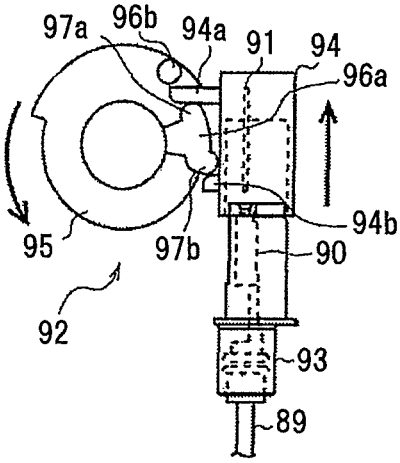

When the cam 9*a* is rotated from the tightened position in the direction opposite to the tightening direction, the arc portion 97*a* of the front protrusion 96*a* comes into contact with the case-side protrusion 94*a*, as shown in FIG. 18A. When the cam 9*a* is further rotated, the arc portion 97*a* of the front protrusion 96*a* butts against the case-side protrusion 94*a* and the second fitting detection terminal case 94 slides in a direction opposite to the first fitting detection terminal 90 in accordance with the rotation of the slide ring 95, as shown in FIG. 18B. In the state shown in FIG. 18B, the first fitting detection terminal 90 and the second fitting detection terminal 91 are electrically disconnected but the pressing force is still applied to each contact point since the cam 9*a* does not reach the release position.

Figure 18C:
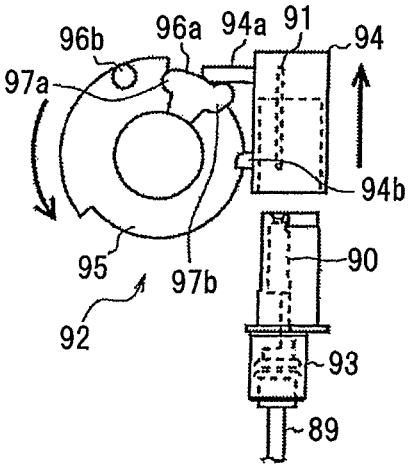

When the cam 9*a* is further rotated in the direction opposite to the tightening direction, the arc portion 97*a* of the front protrusion 96*a* is disengaged from the case-side protrusion 94*a* and the protruding portion 97*b* of the front protrusion 96*a* comes into contact with the case-side protrusion 94*a* as shown in FIG. 18C and, at the release position, the second fitting detection terminal case 94 is restricted from moving forward in the sliding direction. Note that, in order to facilitate the disengagement of the front protrusion 96*a*, an edge of the top end portion of the case-side protrusion 94*a* on the front side in the sliding direction (on the first fitting detection terminal 90 side) is rounded.

As such, in the present embodiment, the slide means 92 is configured to electrically disconnect the first fitting detection terminal 90 from the second fitting detection terminal 91 and subsequently to release each contact point from the pressing force when the cam 9*a* is rotated from the tightened position in the direction opposite to the tightening direction. As a result, it is possible to release each contact point from the pressing force after securely interrupting an electric current flowing through each contact point and then to allow the two terminal housings 5 and 7 to be detached, which further improves safety.

Effects of the Present Embodiment

The effects of the present embodiment will be described.

The connector 1 in the present embodiment is provided with the connecting member 9 for collectively fixing and electrically connecting the plural first connecting terminals 4*a* to 4*c* and the plural second connecting terminals 6*a* to 6*c* at each contact point by rotating the cam 9*a* in the tightening direction and thereby pressing each contact point, the first fitting detection terminal 90 provided on one of the first terminal housing 5 and the second terminal housing 7, the second fitting detection terminal 91 provided on the other of the first terminal housing 5 and the second terminal housing 7 so as to be slidable along the fitting direction of the two terminal housings 5 and 7, and the slide means 92 which makes the second fitting detection terminal 91 slide in accordance with the rotation of the cam 9*a* and electrically connects the first fitting detection terminal 90 to the second fitting detection terminal 91 when fitting the two terminal housings 5 and 7 and then rotating the cam 9*a* in the tightening direction.

Such a configuration allows a single operation of rotating the cam 9*a* to apply a pressing force to each contact point as well as to electrically connect the first fitting detection terminal 90 to the second fitting detection terminal 91 and it is thus possible to significantly improve workability of connection work to connect the two connector portions 2 and 3.

In addition, in the connector 1, the both fitting detection terminals 90 and 91 are electrically connected in the state that each contact point is fixed. Therefore, unlike the conventional art, there is no possibility of spark generation due to detachment of two terminal housings while the both fitting detection terminals 90 and 91 are electrically connected to each other and it is thus possible to improve safety during the connection work.

In other words, it is possible to realize the laminated-type connector 1 which allows the fitting of the terminal housings 5 and 7 to be detected without impairing workability and safety of the connection work.

In addition, the connector 1 is provided with the insulating member assembly 100 formed by connecting the plural insulating members 8*a* to 8*d* to each other and having the insulating member restricting means 101 for restricting movement of the insulating members 8*a* to 8*d* in a direction perpendicular to a lamination direction of the laminated structure. Therefore, it is possible to reduce positional misalignment of the insulating members 8*a* to 8*d* even when a force (e.g., a force to pull the cables 61*a* to 61*c* or a force to push the cables 61*a* to 61*c* into the first connector portion 2) is applied to the cables 61*a* to 61*c*, and as a result, it is possible to prevent the second connecting terminals 6*a* to 6*c* from butting against the insulating members 8*a* to 8*d* at the time of connecting the two connector portions 2 and 3 and a fitting operation can be smoothly carried out. In addition, the connector 1 does not use a retaining jig unlike conventional connectors and is thus small.

Furthermore, in the connector 1, the first terminal insertion holes 102 and the second terminal insertion holes 103 are formed on the insulating member assembly 100 in order to fit the two terminal housings 5 and 7 such that a length direction of the first connecting terminals 4*a* to 4*c* crosses that of the second connecting terminals 6*a* to 6*c*. Therefore, although the connector 1 has a laminated structure, it is possible to reduce a protruding length from the device when directly connected to the device and it is thus possible to effectively use a wiring space.

It should be noted that the present invention is not intended to be limited to the embodiment, and the various changes can be made without departing from the gist of the present invention.

For example, the case where the first fitting detection terminal 90 is a female terminal and the second fitting detection terminal 91 is a male terminal has been explained in the embodiment, male and female may be reversed.

In addition, the arc portion 97*a* and the protruding portion 97*b* are integrated to form the front protrusion 96*a* in the embodiment but may be separated such that the front protrusion 96*a* is composed of two protrusions. Likewise, the shapes of the rear protrusion 96*b*, the case-side protrusion 94*a* and the case-side auxiliary protrusion 94*b*, etc., can be appropriately changed.

The embodiment assumes the use of a three-phase AC power line, however, according to the technical idea of the invention, it may be, e.g., a connector for a vehicle which is configured to collectively connect lines used for different purposes such as a three-phase AC power line between a motor and an inverter and a two-phase DC power line for air conditioner. Since the configuration described above allows one connector to collectively connect power lines used for different purposes, it is not necessary to prepare different connectors for each intended purpose and it is thus possible to contribute to space saving and cost reduction.

In addition, surfaces of the first connecting terminals 4*a* to 4*c* and of the second connecting terminals 6*a* to 6*c* may be each roughened by a knurling process to increase frictional force so as to make the terminals difficult to move, thereby strengthening the fixation at each contact point.

In addition, although the case where the first connector portion 2 is attached to the device has been described in the embodiment, it is possible to configure such that the first connecting terminals 4*a* to 4*c* are provided at end portions of cables to connect the cables to each other.

Furthermore, although the first connecting terminals 4*a* to 4*c* are inserted through the through-holes 10*a* of the first inner housing 10 and are fixed to the first inner housing 10 in the embodiment, the first inner housing 10 may be integrally formed with the first connecting terminals 4*a* to 4*c* by insert molding.

In addition, although the case where the first insulating members 8*b* to 8*d* are attached to the second connecting terminals 6*a* to 6*c* by fitting the second connecting terminals 6*a* to 6*c* to the fitting grooves 83 has been described in the embodiment, the first insulating members 8*b* to 8*d* may be fixed to the second connecting terminals 6*a* to 6*c* by insert molding or by press-fitting the second connecting terminals 6*a* to 6*c* into the first insulating members 8*b* to 8*d*.

In addition, although a cable excellent in flexibility is used as the cables 61*a* to 61*c* in the embodiment, a rigid cable may be used.

In addition, in the embodiment, a direction of the connecting member 9 may be either substantially horizontal or substantially vertical when the connector is in use. In other words, a direction in a usage state is not a requirement in the use conditions of the connector of the present embodiment.

In addition, although the bolt 9*b* of the connecting member 9 presses the second insulating member 8*a* adjacent thereto via the elastic member 15 which is a portion of the connecting member 9 in the embodiment, the adjacent second insulating member 8*a* may be pressed directly by the bolt 9*b*, not via the elastic member 15.

In addition, although the case of providing the connecting member 9 on only one side of the first terminal housing 5 has been described in the embodiment, the connecting member 9 may be provided on both sides of the first terminal housing 5 so that a pressing force is applied to each contact point by the two connecting members 9 provided on the both sides.

In addition, the first terminal housing 5 may be a part of a housing of a device such as inverter. In other words, the connector 1 may be configured not to include the first connector portion 2. In this case, the wire harness of the invention is the cables 61*a* to 61*c* with the second connector portion 3 provided at an end portion thereof.

Although a packing is provided on the first terminal housing 5 (in the groove 22 of the cylindrical body 20) in the embodiment, the packing may be provided on the second terminal housing 7. In this case, it is preferable that a groove for placing the packing be formed on an inner periphery of the second terminal housing 7.

What is claimed is:

1. A connector, comprising:

a first terminal housing for housing a plurality of first connecting terminals aligned;

a second terminal housing for housing a plurality of second connecting terminals aligned;

a plurality of insulating members aligned and housed in the second terminal housing;

a laminated structure that the plurality of first connecting terminals and the plurality of second connecting terminals are alternately arranged so that one surface of the plurality of first connecting terminals faces one surface of the plurality of second connecting terminals to form pairs and to form a plurality of contact points sandwiched between the plurality of insulating members when the first terminal housing is fitted to the second terminal housing;

a connecting member for collectively fixing and electrically connecting the plurality of first connecting terminals and the plurality of second connecting terminals at each contact point by rotating a cam in a tightening direction and thereby pressing each contact point;

a first fitting detection terminal provided on one of the first and second terminal housings;

a second fitting detection terminal provided on the other of the first and second terminal housings so as to be slidable along a fitting direction of the two terminal housings; and a slide means that makes the second fitting detection terminal slide in accordance with the rotation of the cam and electrically connects the first fitting detection terminal to the second fitting detection terminal when fitting the two terminals housings and then rotating the cam in the tightening direction.

2. The connector according to claim 1, wherein the slide means is configured to electrically connect the first fitting detection terminal to the second fitting detection terminal after a pressing force is applied to each contact point when fitting the two terminals housings and then rotating the cam in the tightening direction.

3. The connector according to claim 1, wherein the slide means is configured to electrically disconnect the first fitting detection terminal from the second fitting detection terminal when the cam is rotated from a tightened position in a direction opposite to the tightening direction.

4. The connector according to claim 3, wherein the slide means is configured to electrically disconnect the first fitting detection terminal from the second fitting detection terminal and subsequently to release each contact point from the pressing force when the cam is rotated from the tightened position in the direction opposite to the tightening direction.

5. The connector according to claim 1, further comprising a second fitting detection terminal case for holding the second fitting detection terminal, wherein the slide means comprises a case-side protrusion provided on the second fitting detection terminal case and a slide ring comprising a ring portion rotating integrally with the cam and a ring-side protrusion coming in contact with the case-side protrusion to slide the second fitting detection terminal case when the ring portion is rotated.

6. The connector according to claim 5, wherein the ring-side protrusion comprises two protrusions, a front protrusion formed along a circumferential direction of the ring portion and a rear protrusion, wherein the rear protrusion butts against the case-side protrusion to slide the second fitting detection terminal case when fitting the two terminals housings and then rotating the cam in the tightening direction, and wherein the front protrusion butts against the case-side protrusion to slide the second fitting detection terminal case in a direction opposite to the first fitting detection terminal when the cam is rotated from a tightened position in a direction opposite to the tightening direction.

7. The connector according to claim 6, further comprising a case-side auxiliary protrusion formed on the second fitting detection terminal case on a front side in a sliding direction with respect to the case-side protrusion, wherein, when fitting the two terminals housings and then rotating the cam in the tightening direction, the front protrusion butts against the case-side auxiliary protrusion to slide the second fitting detection terminal case toward the first fitting detection terminal and subsequently the rear protrusion butts against the case-side protrusion to slide the second fitting detection terminal case toward the first fitting detection terminal.

8. A connector, comprising:

a second terminal housing for housing a plurality of second connecting terminals aligned;

a plurality of insulating members aligned and housed in the second terminal housing;

a laminated structure that a plurality of first connecting terminals and the plurality of second connecting terminals are alternately arranged so that one surface of the plurality of first connecting terminals faces one surface of the plurality of second connecting terminals to form pairs and to form a plurality of contact points sandwiched between the plurality of insulating members when the second terminal housing is fitted to a first terminal housing that is a housing to be fitted to the second terminal housing and houses the plurality of first connecting terminals aligned;

a connecting member for collectively fixing and electrically connecting the plurality of first connecting terminals and the plurality of second connecting terminals at each contact point by rotating a cam in a tightening direction and thereby pressing each contact point;

a second fitting detection terminal provided on the second terminal housing so as to be slidable along a fitting direction of the two terminal housings; and a slide means that makes the second fitting detection terminal slide in accordance with the rotation of the cam and electrically connects the first fitting detection terminal provided on the first terminal housing to the second fitting detection terminal when fitting the two terminals housings and then rotating the cam in the tightening direction.

9. A wire harness, comprising:

a plurality of cables;

a plurality of second connecting terminals to be connected to the plurality of cables;

a second terminal housing for housing the plurality of second connecting terminals aligned;

a plurality of insulating members aligned and housed in the second terminal housing;

a laminated structure that a plurality of first connecting terminals and the plurality of second connecting terminals are alternately arranged so that one surface of the plurality of first connecting terminals faces one surface of the plurality of second connecting terminals to form pairs and to form a plurality of contact points sandwiched between the plurality of insulating members when the second terminal housing is fitted to a first terminal housing that is a housing to be fitted to the second terminal housing and houses the plurality of first connecting terminals aligned;

a connecting member for collectively fixing and electrically connecting the plurality of first connecting terminals and the plurality of second connecting terminals at each contact point by rotating a cam in a tightening direction and thereby pressing each contact point;

a second fitting detection terminal provided on the second terminal housing so as to be slidable along a fitting direction of the two terminal housings; and a slide means that makes the second fitting detection terminal slide in accordance with the rotation of the cam and electrically connects the first fitting detection terminal provided on the first terminal housing to the second fitting detection terminal when fitting the two terminals housings and then rotating the cam in the tightening direction.

* * * * *